US012037799B2

(12) United States Patent
Mendiluza

(10) Patent No.: US 12,037,799 B2
(45) Date of Patent: Jul. 16, 2024

(54) TILE LEVELING DEVICE

(71) Applicant: Right Standard, LLC, Cape Coral, FL (US)

(72) Inventor: Raunier Mendiluza, Cape Coral, FL (US)

(73) Assignee: Right Standard, LLC, Cape Coral, FL (US)

( * ) Notice: Subject to any disclaimer, the term of this patent is extended or adjusted under 35 U.S.C. 154(b) by 170 days.

(21) Appl. No.: 17/820,038

(22) Filed: Aug. 16, 2022

(65) Prior Publication Data

US 2022/0389723 A1 Dec. 8, 2022

Related U.S. Application Data

(63) Continuation-in-part of application No. 17/121,656, filed on Dec. 14, 2020, now abandoned, which is a continuation-in-part of application No. 16/627,686, filed as application No. PCT/US2018/026225 on Apr. 5, 2018, now Pat. No. 10,895,081.

(51) Int. Cl.

| | |
|---|---|
| ***E04F 21/22*** | (2006.01) |
| ***E04F 21/00*** | (2006.01) |
| ***E04F 21/18*** | (2006.01) |

(52) U.S. Cl.

CPC ..... *E04F 21/0092* (2013.01); *E04F 21/1877* (2013.01); *E04F 21/22* (2013.01)

(58) Field of Classification Search

CPC ..... E04F 21/0092; E04F 21/1838; E04F 21/1844; E04F 21/1877; E04F 21/22; E04F 21/18; E04F 21/20; E04F 15/02022; E04F 13/0892

See application file for complete search history.

(56) References Cited

U.S. PATENT DOCUMENTS 4,908,952 A 3/1990 Joos
7,603,825 B2 * 10/2009 Dohren ..... E04C 3/29 52/847

(Continued)

FOREIGN PATENT DOCUMENTS

JP 2012167428 A * 9/2012
JP 2013053514 A * 3/2013 ..... E04F 15/02005

OTHER PUBLICATIONS

PCT/US2018/026225, "Notification of Transmittal of the International Search Report and the Written Opinion of the International Searching Authority, or the Declaration", International Searching Authority, Jun. 29, 2018, pp. 1-9.

*Primary Examiner* — Kyle J. Walraed-Sullivan
(74) *Attorney, Agent, or Firm* — Kunzler Bean & Adamson; Scott D. Thorpe

(57) ABSTRACT

For leveling tile, a tile leveling device includes a tower, a base, and two leveling ridges. The tower includes a cross piece and two struts that extend in a distal direction along a first axis from the cross piece. The base is connected to the two struts at a base intersection and extending along a traverse axis from the two struts, the base comprising two side edges, two front edges, and four diagonal cutouts, wherein the two side edges are each perpendicular to both the two front edges, a diagonal cutout is between each side edge and front edge pair at a diagonal angle and each strut comprises a notch along a break line at an outer intersection. The two leveling ridges are disposed on a proximal surface of the base.

6 Claims, 33 Drawing Sheets

(56) References Cited

U.S. PATENT DOCUMENTS 7,992,354 B2 * 8/2011 Doda, Jr. ..... E04F 13/0892 52/749.11
9,260,872 B2 2/2016 Bunch et al.
D760,566 S * 7/2016 Biec ..... D8/47
9,487,959 B2 11/2016 Bunch et al.
9,534,403 B2 1/2017 Biec
9,970,203 B1 * 5/2018 Abidov ..... E04F 21/1877
D820,059 S * 6/2018 Biec ..... E04F 21/22 D8/47
D821,838 S 7/2018 Castellanos
D829,532 S 10/2018 Bunch et al.
D832,680 S 11/2018 Bunch et al.
D885,862 S * 6/2020 Bacia ..... D8/47
10,895,081 B2 1/2021 Mendiluza et al.
11,643,826 B1 * 5/2023 Troxell ..... E04F 21/22 52/126.5
2002/0148129 A1 10/2002 Donnellan
2008/0236094 A1 10/2008 Doda
2013/0055675 A1 * 3/2013 Sighinolfi ..... E04F 15/02022 52/749.11
2013/0263462 A1 10/2013 Funk
2014/0033640 A1 * 2/2014 Gorton ..... E04F 21/0092 52/749.11
2014/0116001 A1 * 5/2014 Ghelfi ..... E04F 21/0092 52/749.11
2014/0298736 A1 * 10/2014 Bunch ..... E04F 21/0092 52/126.1
2015/0240504 A1 * 8/2015 Hoffman ..... E04F 15/0215 29/244
2015/0308130 A1 * 10/2015 Biec ..... E04F 21/0092 52/749.11
2016/0090746 A1 * 3/2016 Sighinolfi ..... E04F 21/0092 33/526
2016/0186449 A1 * 6/2016 Lee ..... E04F 21/1877 33/527
2016/0222679 A1 * 8/2016 Bunch ..... E04F 21/1877
2016/0326754 A1 * 11/2016 Bucsa ..... E04F 21/20
2018/0163415 A1 * 6/2018 Psaila ..... E04F 21/0092
2018/0291640 A1 * 10/2018 Sighinolfi ..... E04F 21/0092
2018/0355623 A1 * 12/2018 Frisco ..... E04F 15/02022
2019/0048599 A1 * 2/2019 Papadatos ..... E04F 21/0092
2019/0063084 A1 * 2/2019 Bunch ..... E04F 21/0092
2019/0169863 A1 * 6/2019 Torrents Comas . E04F 21/1877
2019/0309531 A1 * 10/2019 Li ..... B25B 7/22
2019/0383027 A1 * 12/2019 Sighinolfi ..... E04F 21/22
2020/0056381 A1 * 2/2020 Castellanos ..... E04F 21/0092
2020/0063448 A1 * 2/2020 Morrow ..... E04F 21/1877
2020/0149295 A1 * 5/2020 Mendiluza ..... E04F 21/0092
2020/0173181 A1 * 6/2020 Gorton ..... E04F 21/0092
2020/0224434 A1 * 7/2020 Troxell ..... E04F 21/22
2020/0240154 A1 * 7/2020 Nudo ..... E04F 13/0892
2020/0318366 A1 * 10/2020 Sighinolfi ..... E04F 21/22
2020/0347617 A1 * 11/2020 Troxell ..... E04F 21/0092
2021/0062522 A1 * 3/2021 Castellanos ..... E04F 21/0092
2021/0071432 A1 * 3/2021 Bordin ..... E04F 21/22
2021/0095481 A1 * 4/2021 Mendiluza ..... E04F 21/22
2021/0131124 A1 * 5/2021 Bunch ..... E04F 21/22
2021/0180339 A1 * 6/2021 Prestes de Andrade ..... E04F 21/00
2021/0363764 A1 * 11/2021 Sighinolfi ..... E04F 21/1844
2021/0363765 A1 * 11/2021 Cipriani ..... E04F 13/0892
2022/0025662 A1 * 1/2022 Sighinolfi ..... E04F 15/02022
2022/0251856 A1 * 8/2022 Bunch ..... E04F 21/22
2024/0068246 A1 * 2/2024 Bunch ..... E04F 21/22

* cited by examiner

TILE LEVELING DEVICE

CROSS-REFERENCE TO RELATED APPLICATIONS

This application is a continuation-in-part of and claims priority to U.S. patent application Ser. No. 17/121,656 entitled "TILE LEVELING TENSIONER" filed Dec. 14, 2020 for Raunier Mendiluza, which is incorporated herein by reference and which is a continuation-in-part of and claims priority to U.S. patent application Ser. No. 16/627,686 entitled "TILE LEVELING DEVICE" filed on Dec. 23, 2019 for Raunier Mendiluza, which is incorporated herein by reference, and which is a US nationalization of and claims priority to PCT Application PCT/US18/26225 entitled "TILE LEVELING DEVICE" filed on Apr. 5, 2018 for Eventile, Inc., which is incorporated herein by reference.

FIELD

The subject matter disclosed herein relates to a tile leveling device for leveling tiles.

BACKGROUND

Description of the Related Art

Ceramic tiles must be laid in a level position.

BRIEF SUMMARY

A tile leveling device is disclosed. The tile leveling device includes a tower, a base, and two leveling ridges. The tower includes a cross piece and two struts that extend in a distal direction along a first axis from the cross piece. The base is connected to the two struts at a base intersection and extending along a traverse axis from the two struts, the base comprising two side edges, two front edges, and four diagonal cutouts, wherein the two side edges are each perpendicular to both the two front edges, a diagonal cutout is between each side edge and front edge pair at a diagonal angle and each strut comprises a notch along a break line at an outer intersection. The two leveling ridges are disposed on a proximal surface of the base, each leveling ridge comprising a platform perpendicular to the first axis, and the two platforms form a tension gap and each platform extends unbroken through the tension gap, a platform height from the proximal surface along the first axis is at least one quarter a platform width along a cross axis and a platform gap between the two platforms is greater than twice the platform width, each leveling ridge further comprising leveling ramps that slope from the platform along a traverse axis to the proximal surface, wherein an intersection of each leveling ramp and the proximal surface is separated from a nearest front edge by a proximal surface gap.

BRIEF DESCRIPTION OF THE DRAWINGS

A more particular description of the embodiments briefly described above will be rendered by reference to specific embodiments that are illustrated in the appended drawings. Understanding that these drawings depict only some embodiments and are not therefore to be considered to be limiting of scope, the embodiments will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Furthermore, the described features, advantages, and characteristics of the embodiments may be combined in any suitable manner. One skilled in the relevant art will recognize that the embodiments may be practiced without one or more of the specific features or advantages of a particular embodiment. In other instances, additional features and advantages may be recognized in certain embodiments that may not be present in all embodiments.

The description of elements in each figure may refer to elements of proceeding figures. Like numbers refer to like elements in all figures, including alternate embodiments of like elements.

Figure 1:
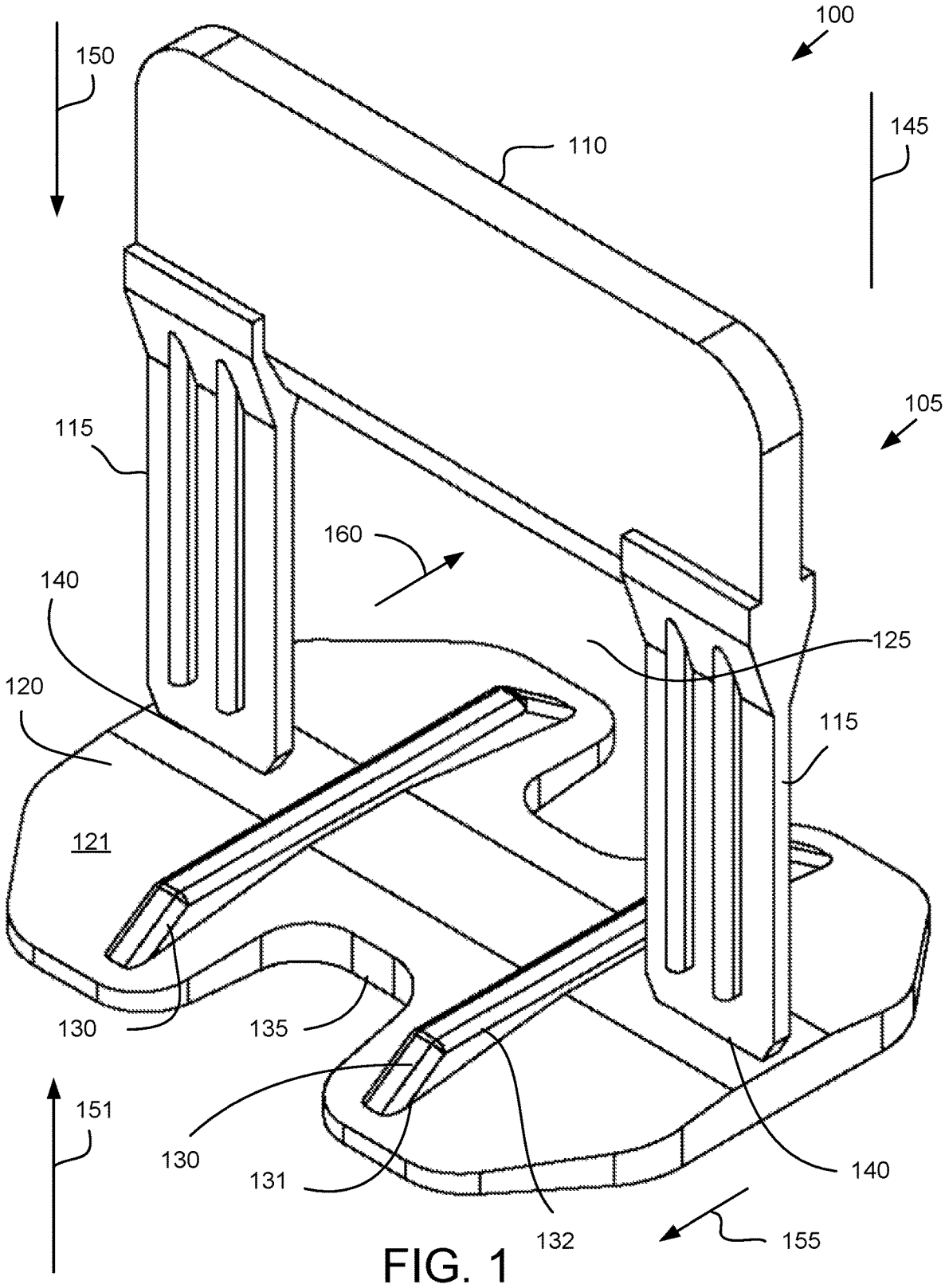
FIG. 1 is a perspective drawing illustrating one embodiment of a tile leveling device.

FIG. 1 is a perspective drawing illustrating one embodiment of a tile leveling device 100. The tile leveling device 100 positions tiles such as ceramic tiles in a relative level positions during installation. In the depicted embodiment, the tile leveling device 100 includes a tower 105, a base 120, and leveling ridges 130.

The tower 105 includes a cross piece 110 and at least one strut 115. In the depicted embodiment, the tower 105 includes two struts 115. The at least one strut 115 extends in a distal direction 150 along a first axis 145 from the cross piece 110.

The base 120 may be connected to the at least one strut 115 at base intersections 140 and may extend traversely in one or more of a first traverse direction 155 and a second traverse direction 160 from the at least one strut 115. In one embodiment, the base 120 extends in the first traverse direction 155 traverse to the tower 105. In addition, the base 120 may extend in the second traverse direction 160 opposite the first traverse direction 155 from the tower 105. The first traverse direction 155 and the second traverse direction 160 may be orthogonal to the first axis 145.

The cross piece 110, the at least one strut 115, and the base 120 may form a tension gap 125. In the depicted embodiment, the tension gap 125 is bounded by the two struts 115, the cross piece 110, and the base 120.

The base 120 includes one or more leveling ridges 130. The leveling ridges 130 may be disposed on a proximal surface 121 of the base 120. Each leveling ridge 130 may comprise a distal ridge side 131 connected to the base 120 and a proximal ridge surface 132 in a proximal direction 151 along the first axis 145 from the base 120.

In the depicted embodiment, the base 120 includes a mortar passage 135. The mortar passage 135 may be disposed between the leveling ridges 130. The mortar passage 135 may allow mortar to pass between the leveling ridges 130 and/or the base 120.

Figure 2:
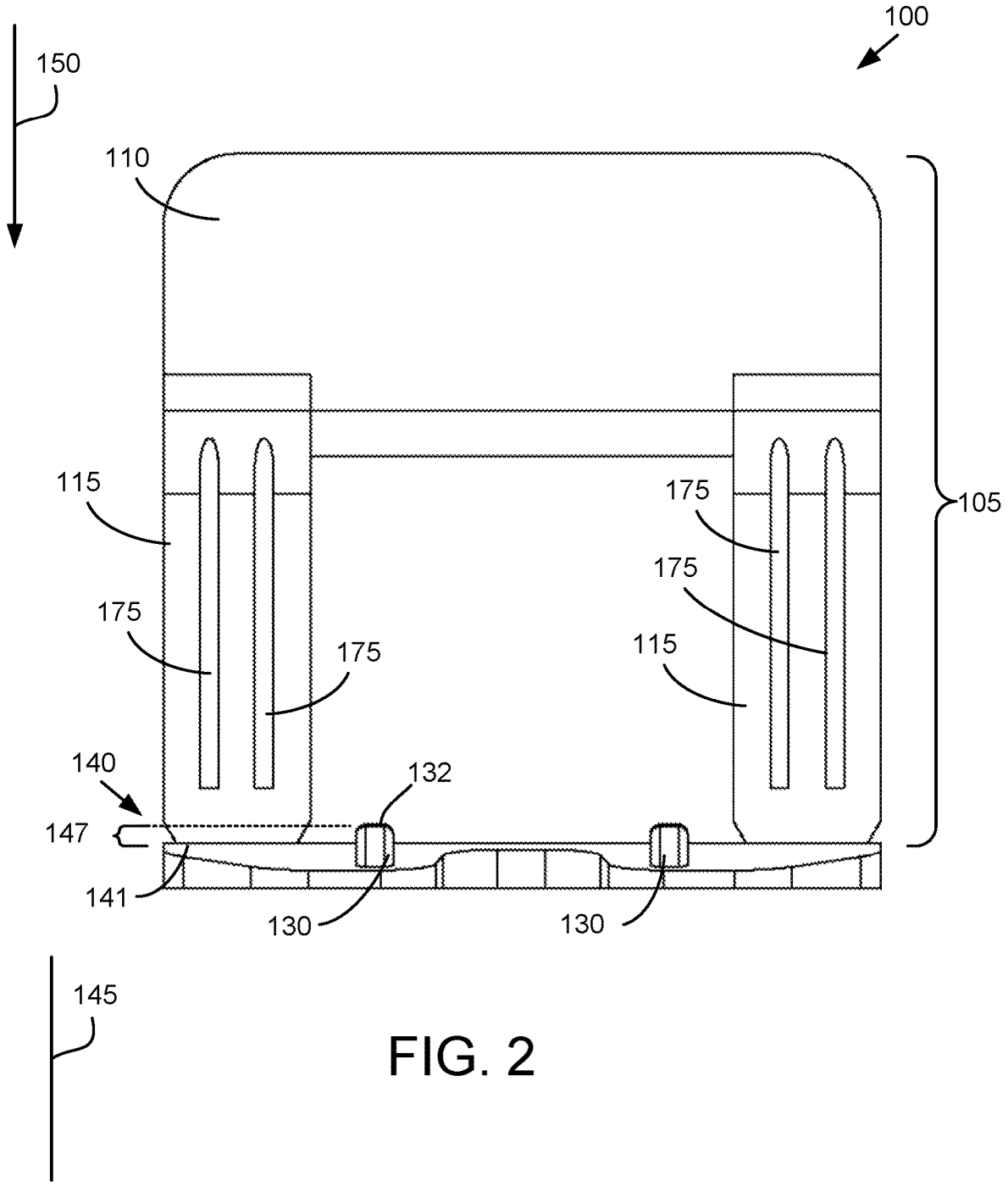
FIG. 2 is a front view drawing illustrating one embodiment of a tile leveling device.

FIG. 2 is a front view drawing illustrating one embodiment of a tile leveling device 100. In the depicted embodiment, each strut 115 includes a break line 141 disposed at the base intersection 140. The break line 141 may be disposed at an offset distance 147 in the distal direction 150 along the first axis 145 from and/or relative to the proximal ridge surface 132. The offset distance 147 may be in the range of 0.5 to 3 millimeters (mm). In one embodiment, the offset distance 147 is 1 mm. The offset distance 147 may permit mortar to fill between a tile (not shown) disposed on the leveling ridge 130 and the base 120, improving set of the tile.

In one embodiment, each strut 115 includes one or more spacing bars 175. The spacing bars 175 may maintain a specified spacing between tiles.

Figure 3A:
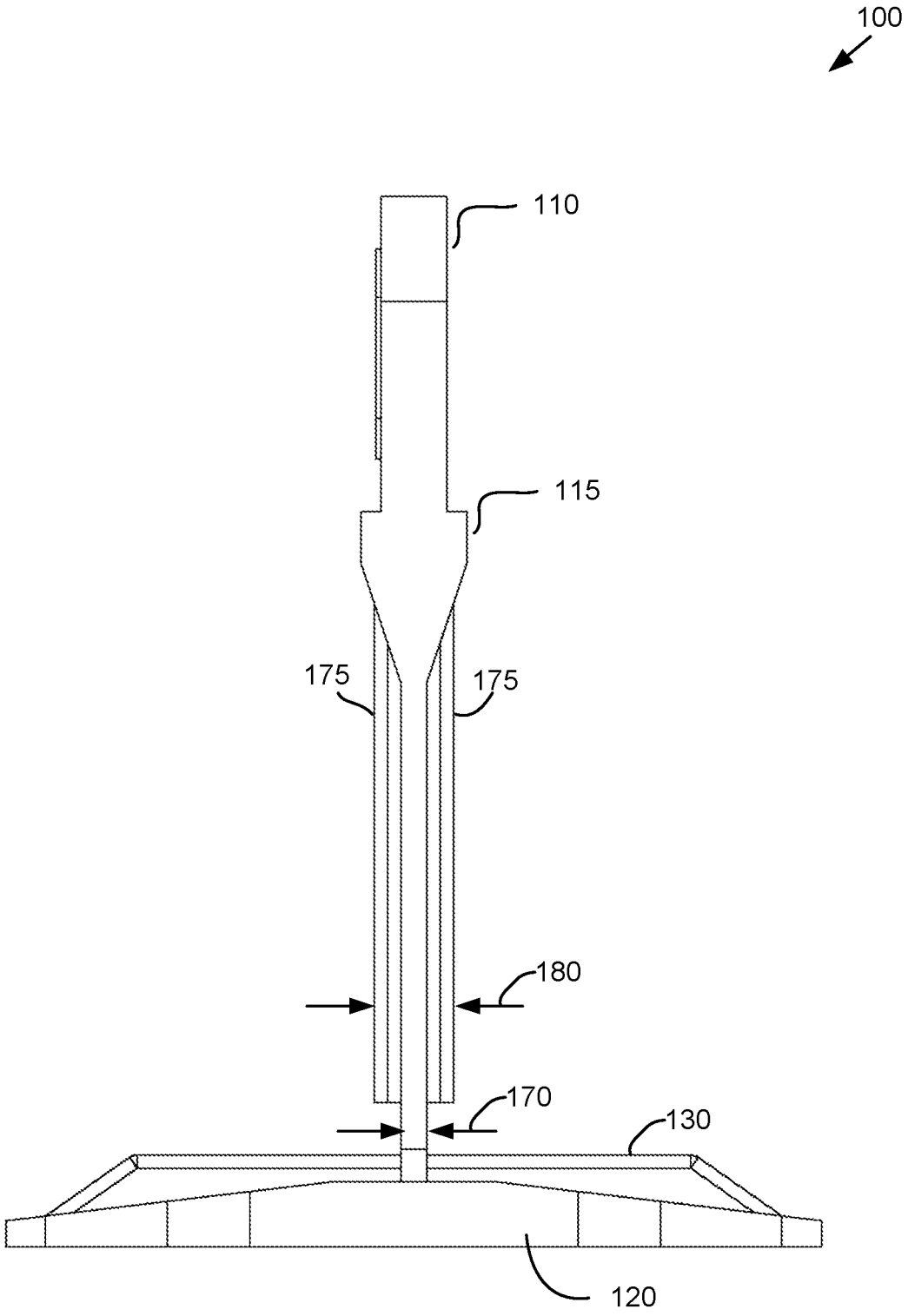
FIG. 3A is a side view drawing illustrating one embodiment of a tile leveling device.

FIG. 3A is a side view drawing illustrating one embodiment of a tile leveling device 100. In the depicted embodiment, each strut 115 has a first traverse width 170. The first traverse width 170 may be a first desired spacing between tiles. In one embodiment, the first traverse width 170 is in the range of 0.5 to 1.5 mm. In a certain embodiment, the first traverse width 170 is 1 mm.

The total of a width of one or more spacing bars 175 and the first traverse width 170 is a second traverse width 180. In one embodiment, the second traverse width 180 is in the range of 1.5-5 mm. Each spacing bar 175 may have a width of 1 mm. The second traverse width may be 1 mm for no spacing bars 175, 2 mm for one spacing bar 175, and 3 mm for two spacing bars 17 as shown.

Figure 3B:
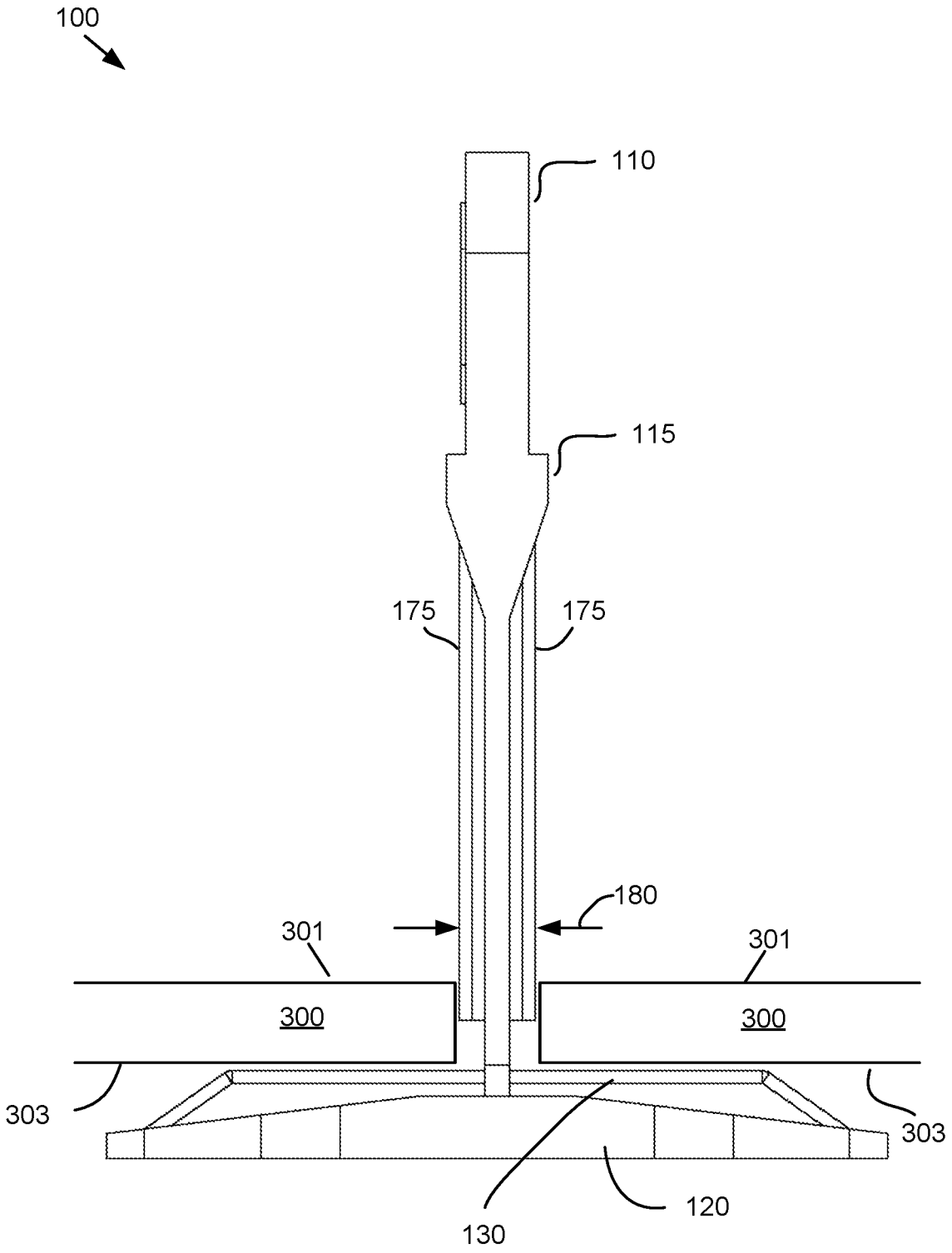
FIG. 3B is a side view drawing illustrating one embodiment of a tile leveling device and tiles.

FIG. 3B is a side view drawing illustrating one embodiment of a tile leveling device 100 with spacing bars 175 and tiles 300. In the depicted embodiment, tiles 300 are disposed on the leveling ridges 130. Distal surfaces 303 of the tiles 300 are disposed on the leveling ridges 130. The tiles 300 may further include proximal surfaces 301. The tiles 300 further abut the spacing bars 175. As a result, the tiles 300 are separated by the second traverse width 180.

Figure 3C:
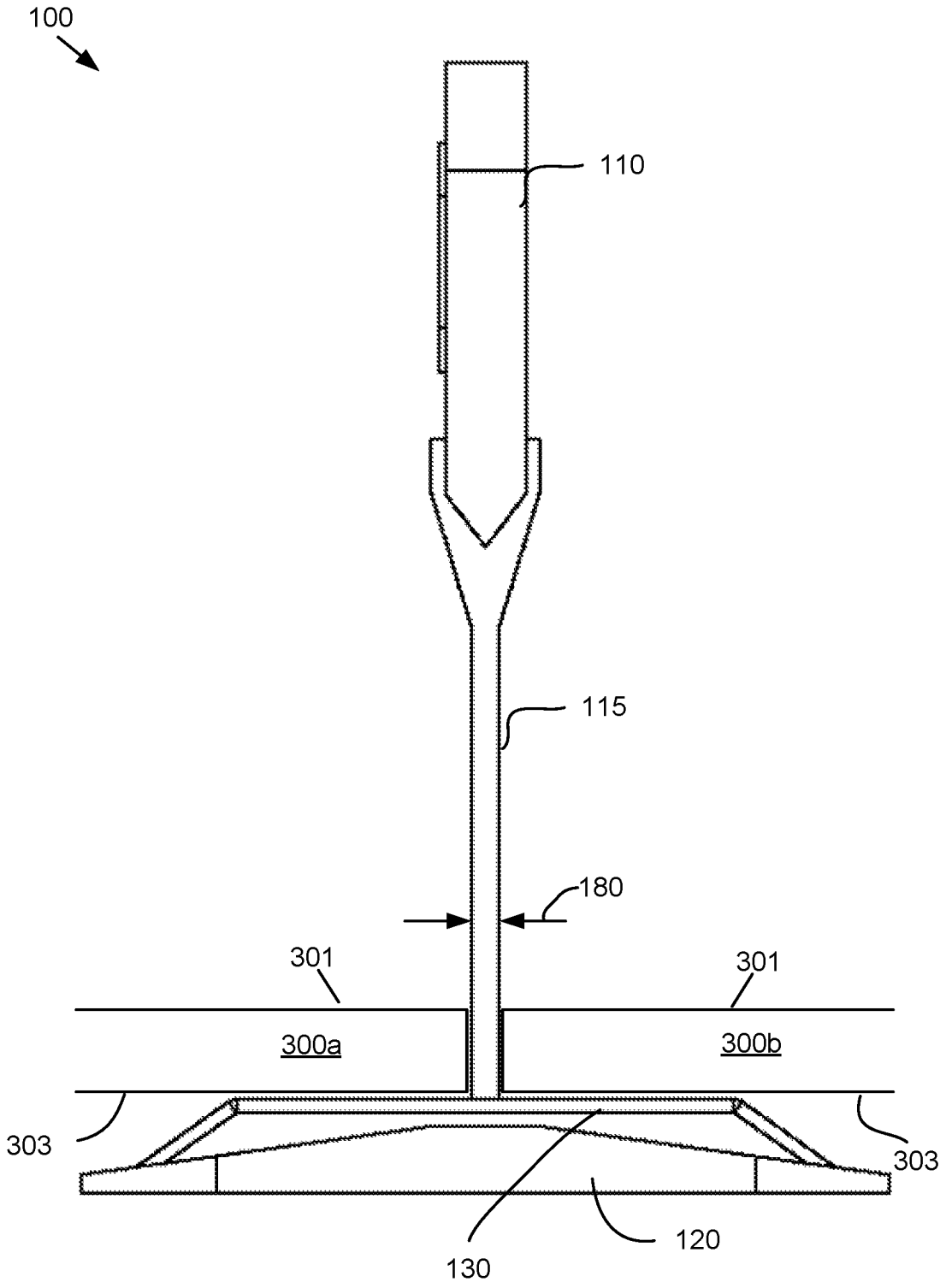
FIG. 3C is a side view drawing illustrating one alternate embodiment of a tile leveling device and tiles.

FIG. 3C is a side view drawing illustrating one alternate embodiment of a tile leveling device 100 without spacing bars 175 and the tiles 300. In the depicted embodiment, the tiles 300 are disposed on the leveling ridges 130. The tiles 300 further abut the struts 115. As a result, the tiles 300 are separated by the first traverse width 170. A distal surface 303 of a first tile 300*a* is shown disposed on the leveling ridges 130. The at least one strut 115 may be disposed against an edge of the first tile 300*a*. Tile distal surface 303 of a second tile 303 is disposed on the at least one leveling ridge 130. The at least one strut 115 is shown disposed against an edge of the second tile 300*b*.

Figure 4A:
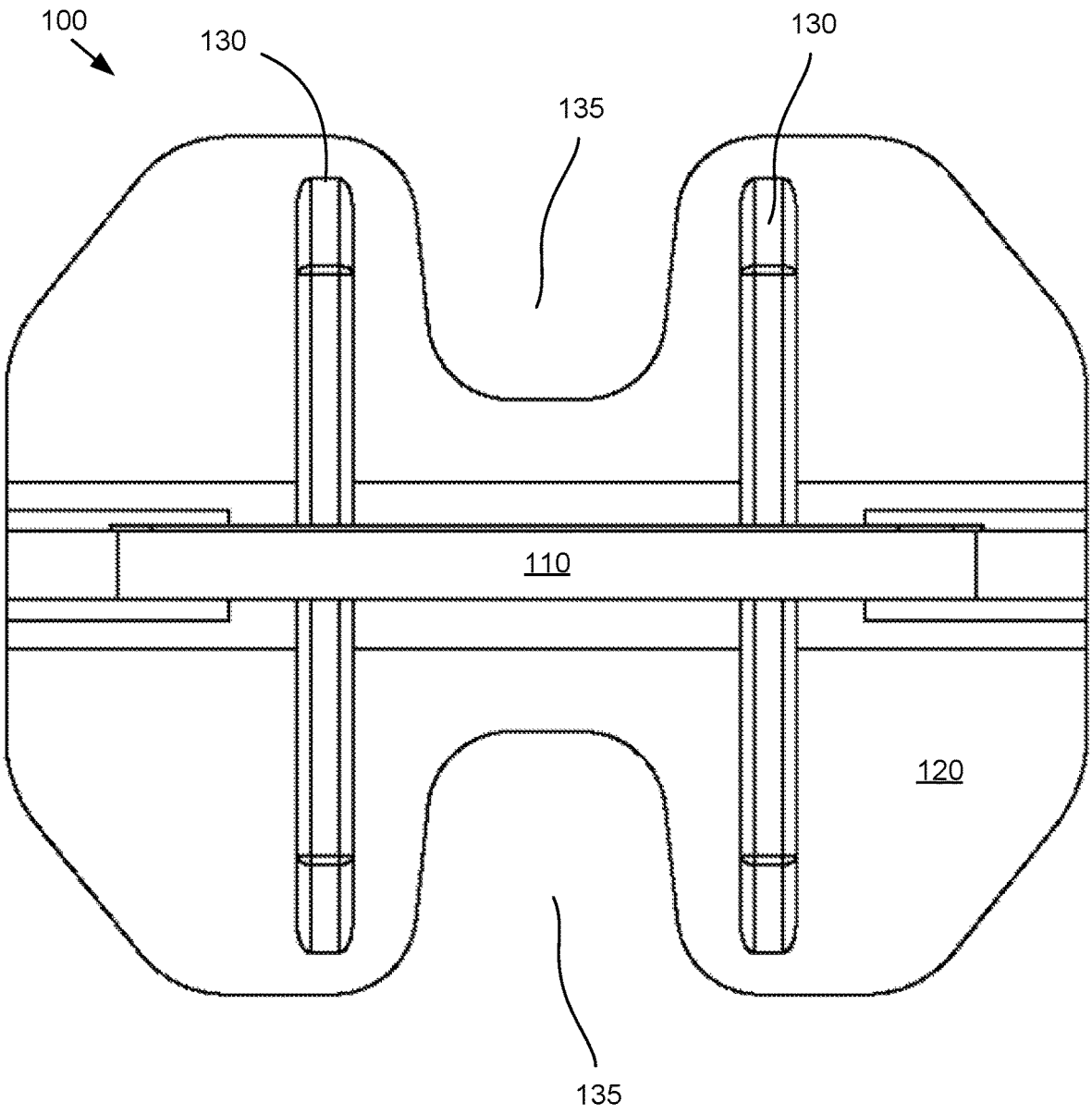
FIG. 4A is a top view drawing illustrating one embodiment of a tile leveling device.

FIG. 4A is a top view drawing illustrating one embodiment of a tile leveling device 100. In the depicted embodiment, the tile leveling device 100 includes two leveling ridges 130. The mortar passages 135 are shown disposed between the leveling ridges 130. In the depicted embodiment, the mortar passages 135 are not bounded by the base 120.

Figure 4B:
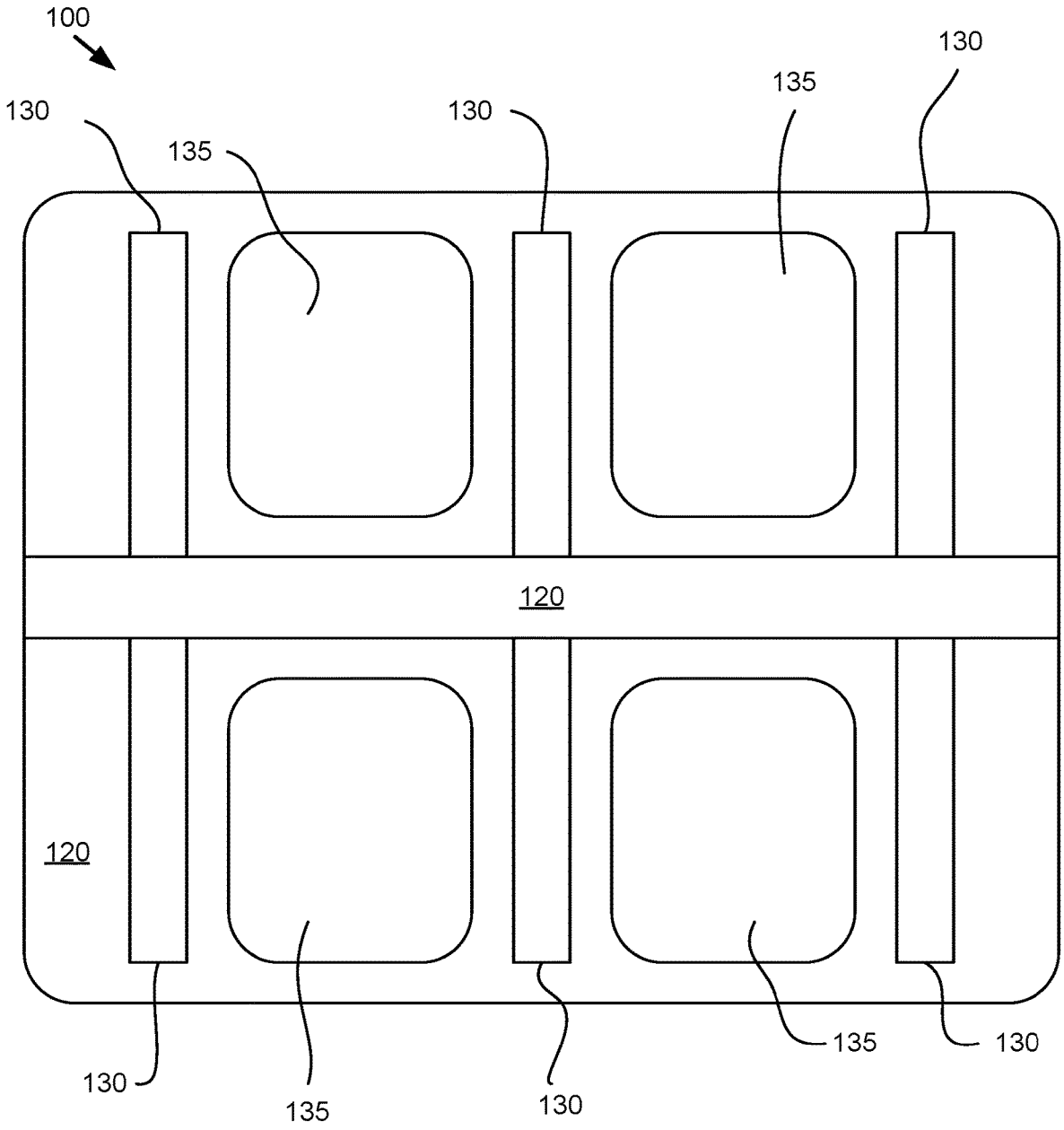
FIG. 4B is a top view drawing illustrating one alternate embodiment of a tile leveling device.

FIG. 4B is a top view drawing illustrating one alternate embodiment of a tile leveling device 100. In the depicted embodiment, the tile leveling device 100 includes three leveling ridges 130. Any number of leveling ridges 130 may be employed.

Mortar passages 135 are shown disposed between the leveling ridges 130. In the depicted embodiment, the mortar passages 135 are bounded by the base 120.

Figure 5:
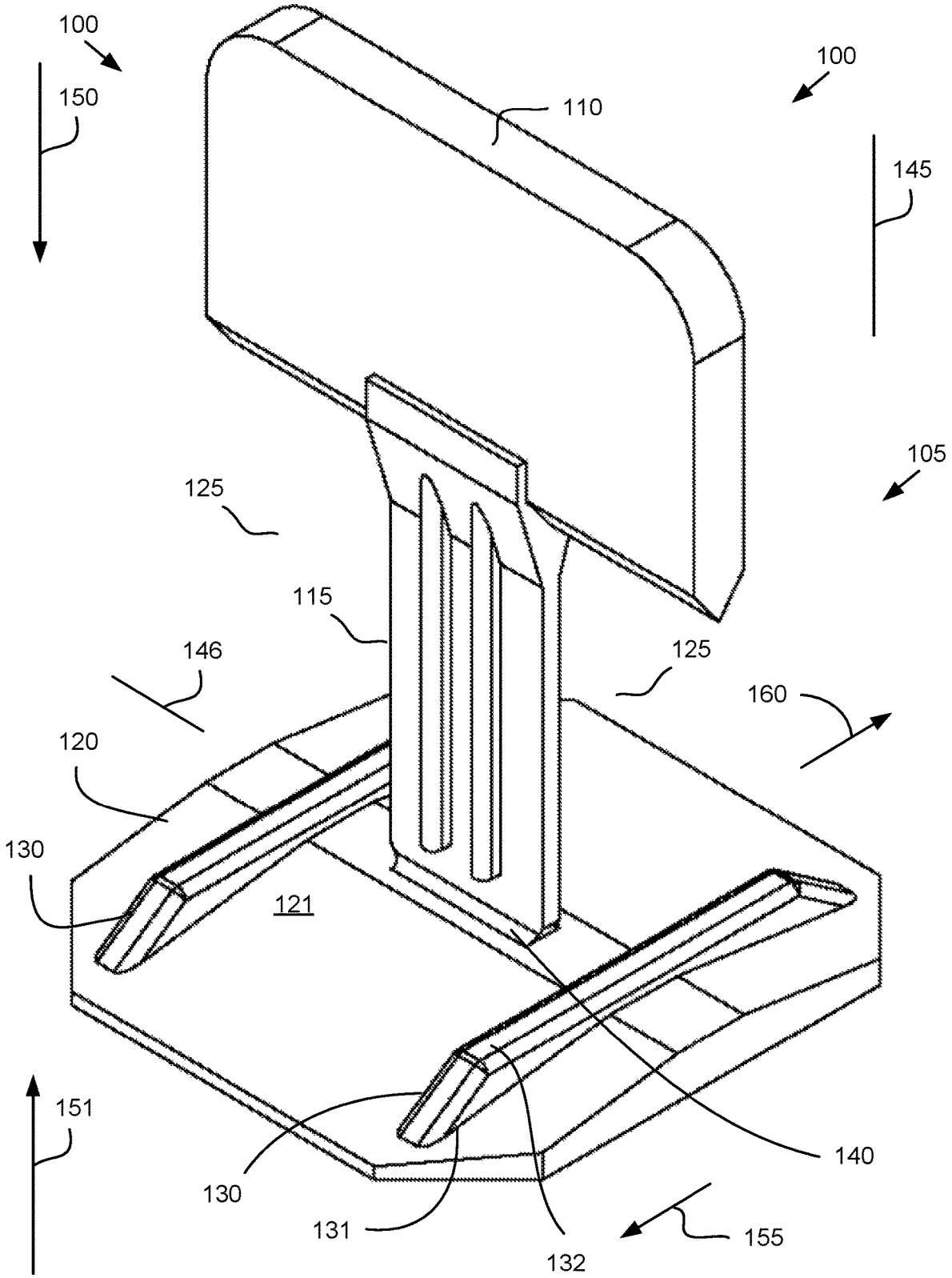
FIG. 5 is a perspective drawing illustrating one alternate embodiment of a tile leveling device.

FIG. 5 is a perspective drawing illustrating one alternate embodiment of a tile leveling device 100. In the depicted embodiment, the tile leveling device 100 comprises one strut 115. The strut 115 may substantially centered along a longitudinal axis 146 of the base 120. As used herein, substantially centered refers to within 20% of a centerline of the base 120 along the longitudinal axis 146.

The tension gap 125 may be formed between the cross piece 110 and the base 120 on both sides of the strut 115 along the longitudinal axis 146. In the depicted embodiment, the tile leveling device 100 does not include a mortar passage 135. Alternate embodiments may include a mortar passage 135.

Figure 6:
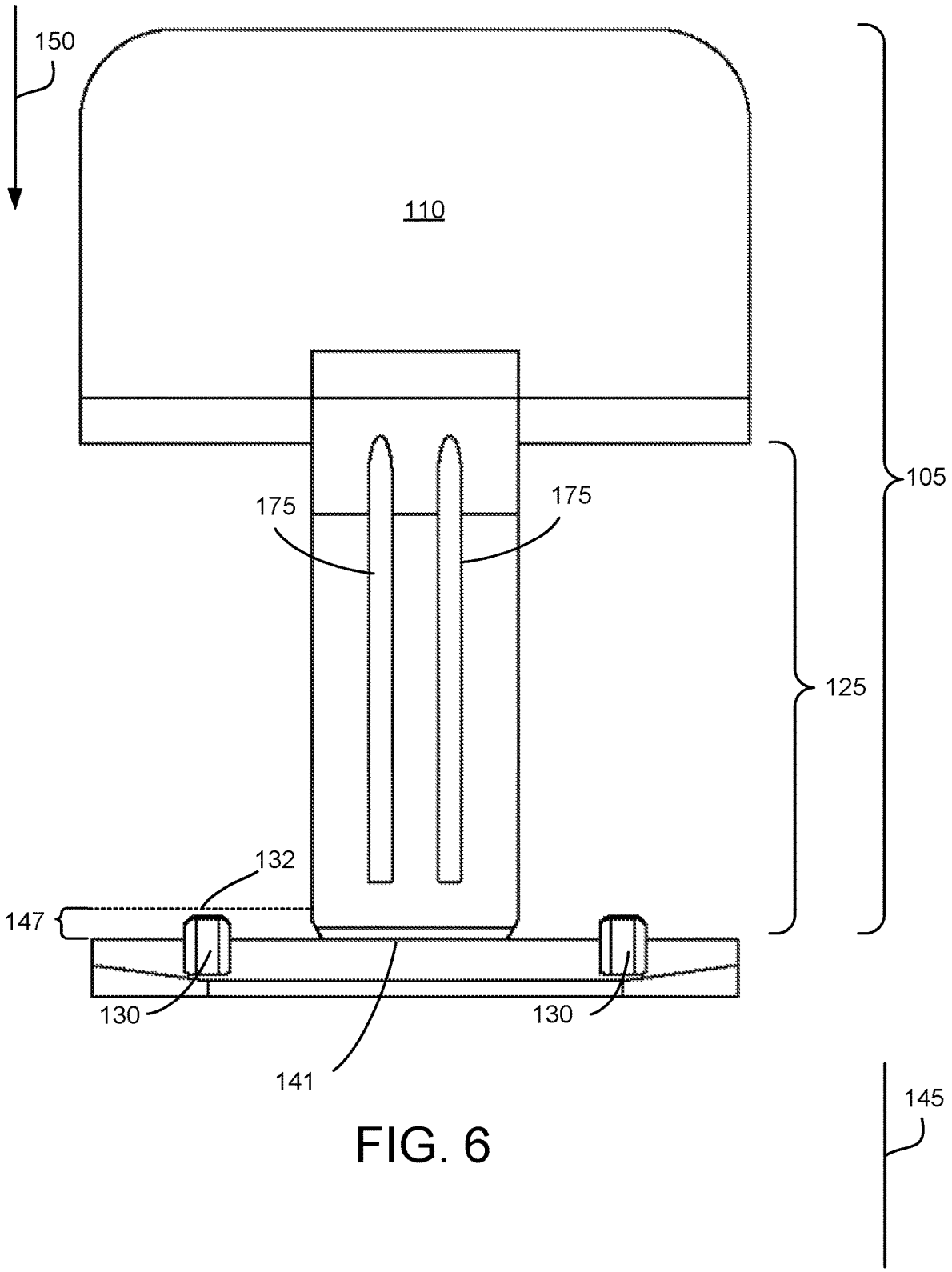
FIG. 6 is a front view drawing illustrating one embodiment of a tile leveling device.

FIG. 6 is a front view drawing illustrating one embodiment of the tile leveling device 100 of FIG. 5. The break line 141 may be disposed an offset distance 147 in the distal direction 150 along the first axis 145 from the proximal ridge surface 132.

Figure 7:
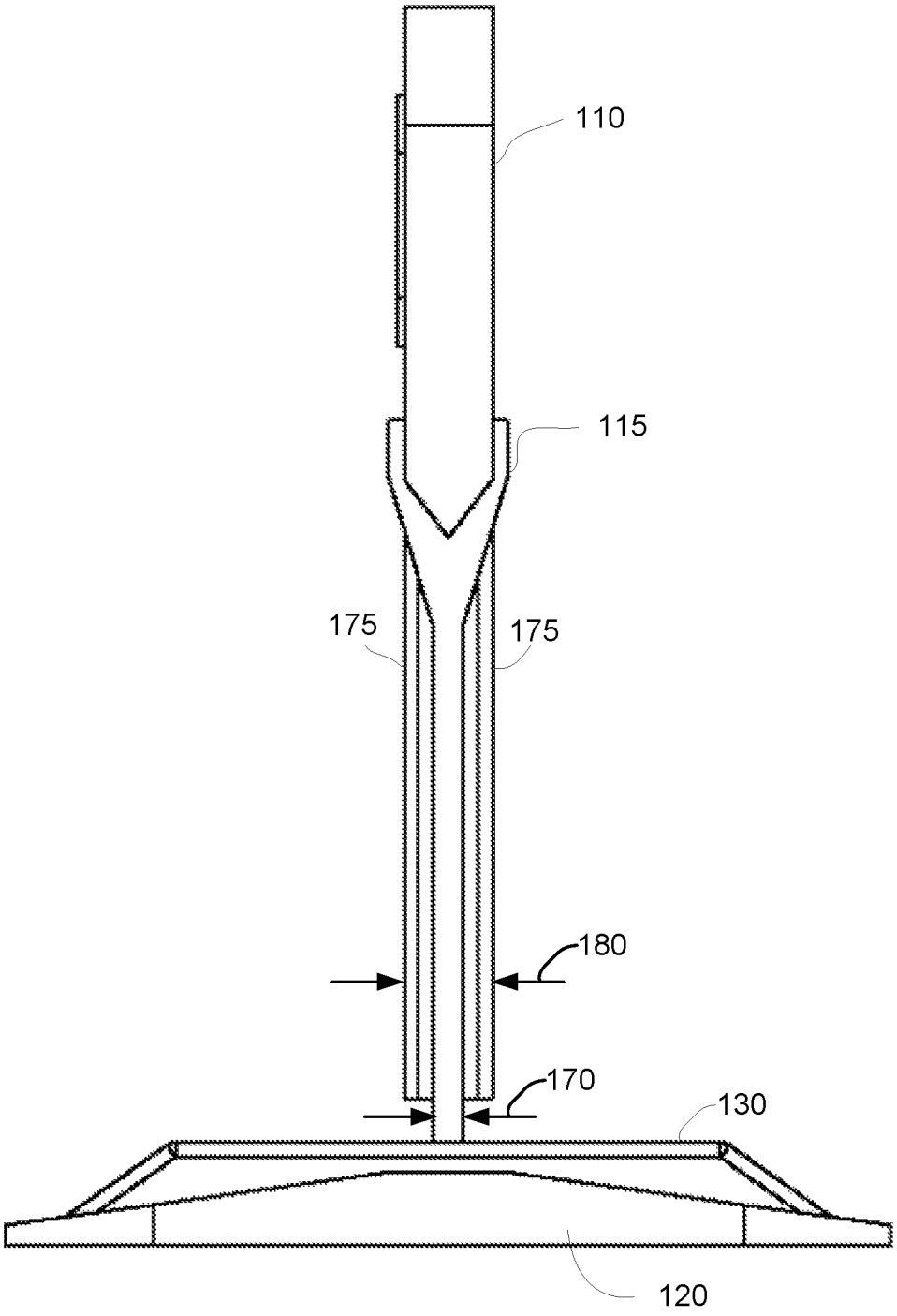
FIG. 7 is a side view drawing illustrating one embodiment of a tile leveling device.

FIG. 7 is a side view drawing illustrating one embodiment of the tile leveling device 100 of FIG. 5. In the depicted embodiment, the single strut 115 has a first traverse width 170. Each spacing bar 175 may have a second traverse width 180.

Figure 8:
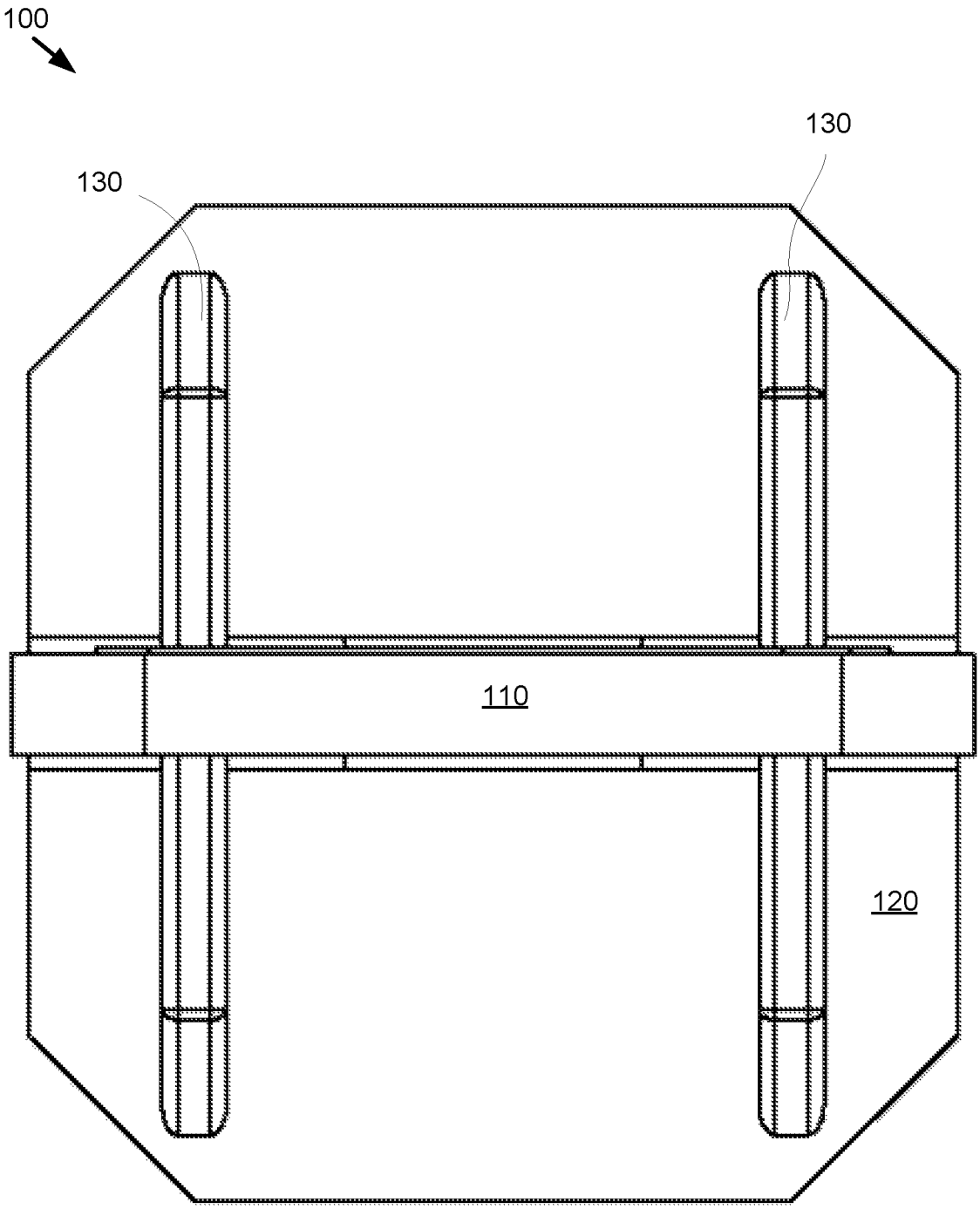
FIG. 8 is a top view drawing illustrating one embodiment of a tile leveling device.

FIG. 8 is a top view drawing illustrating one embodiment of the tile leveling device 100 of FIG. 5. In the depicted embodiment, the tile leveling device 100 includes two leveling ridges 130. No mortar passages 135 are shown.

Figure 9A:
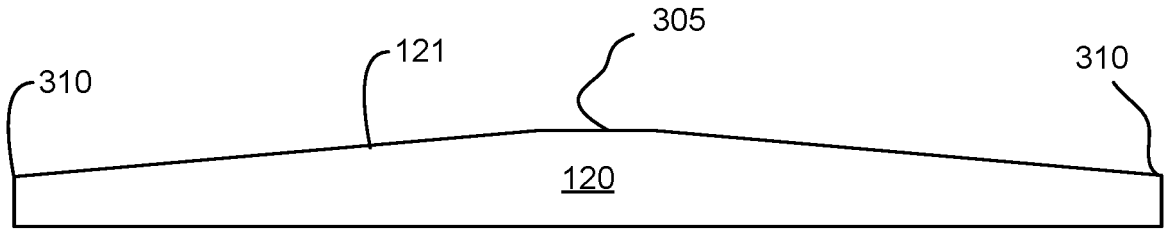
FIG. 9A is a side view drawing illustrating one embodiment of a base.

FIG. 9A is a side view drawing illustrating one embodiment of the base 120. In the depicted embodiment, the proximal surface 121 of the base 120 includes a center 305 and outer edges 310. The proximal surface 121 may slope in the distal direction 150 from the center 305 of the base 120 to one or more outer edges 310 of the base 120. The slope of the proximal surface 121 may be in the range of 1 to 15° relative to the first traverse direction 155 and the second traverse direction 160.

Figure 9B:
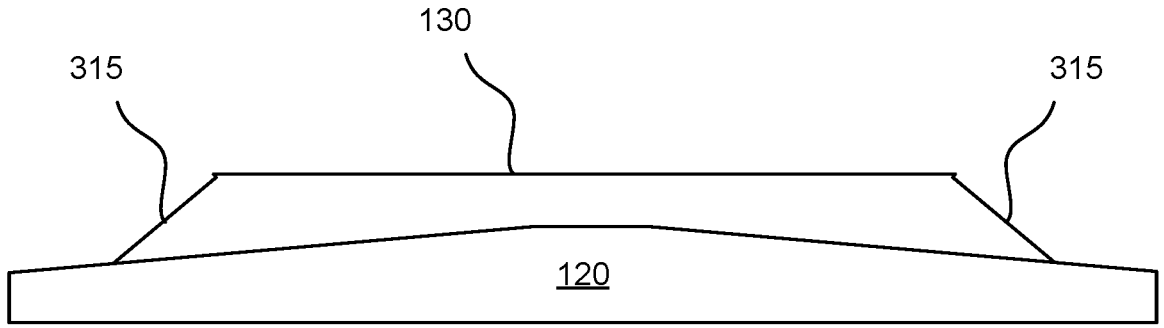
FIG. 9B is a side view drawing illustrating one embodiment of a base and leveling ridge.

FIG. 9B is a side view drawing illustrating one embodiment of the base 120 and leveling ridge 130. In the depicted embodiment, the leveling ridge 130 includes sloped ends 315.

Figure 9C:
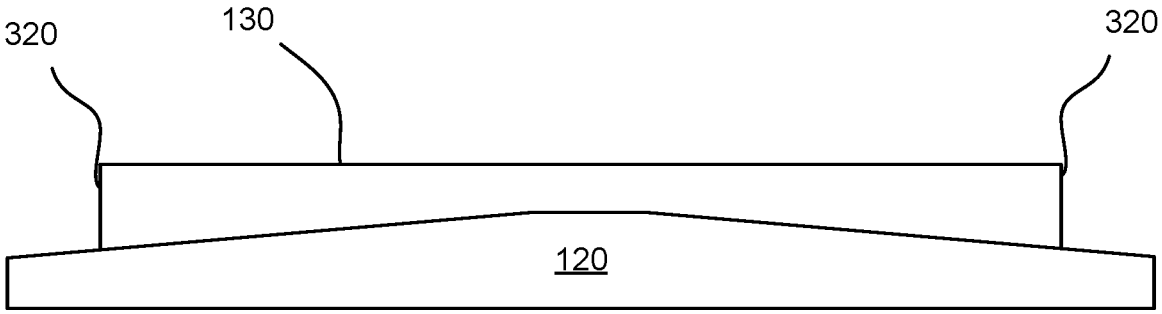
FIG. 9C is a side view drawing illustrating one alternate embodiment of a base and leveling ridge.

FIG. 9C is a side view drawing illustrating one embodiment of the base 120 and leveling ridge 130. In the depicted embodiment, the leveling ridge 130 includes blunt ends 320.

Figure 10:
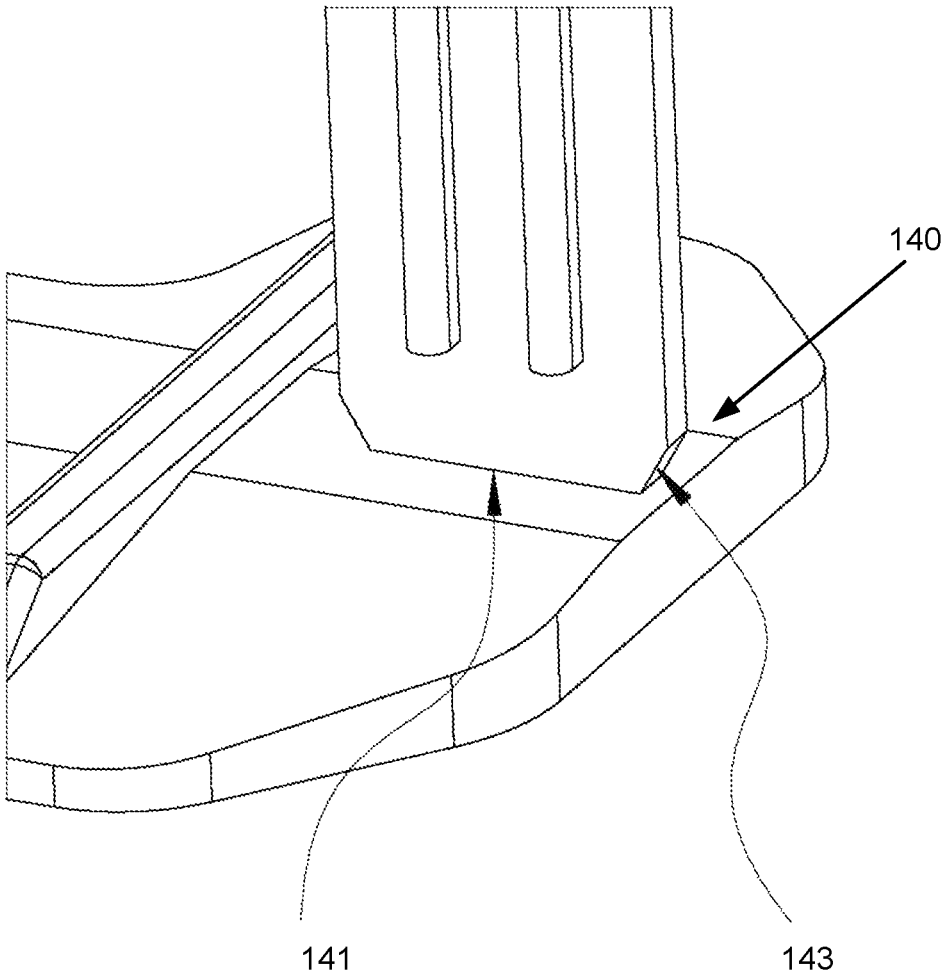
FIG. 10 is a perspective drawing illustrating one embodiment of a base intersection.

FIG. 10 is a perspective drawing illustrating one embodiment of a base intersection 140. In the depicted embodiment, the base intersection 140 includes the break line 141. The strut 115 further includes a notch 143 that extends to the break line 141.

Figure 11A:
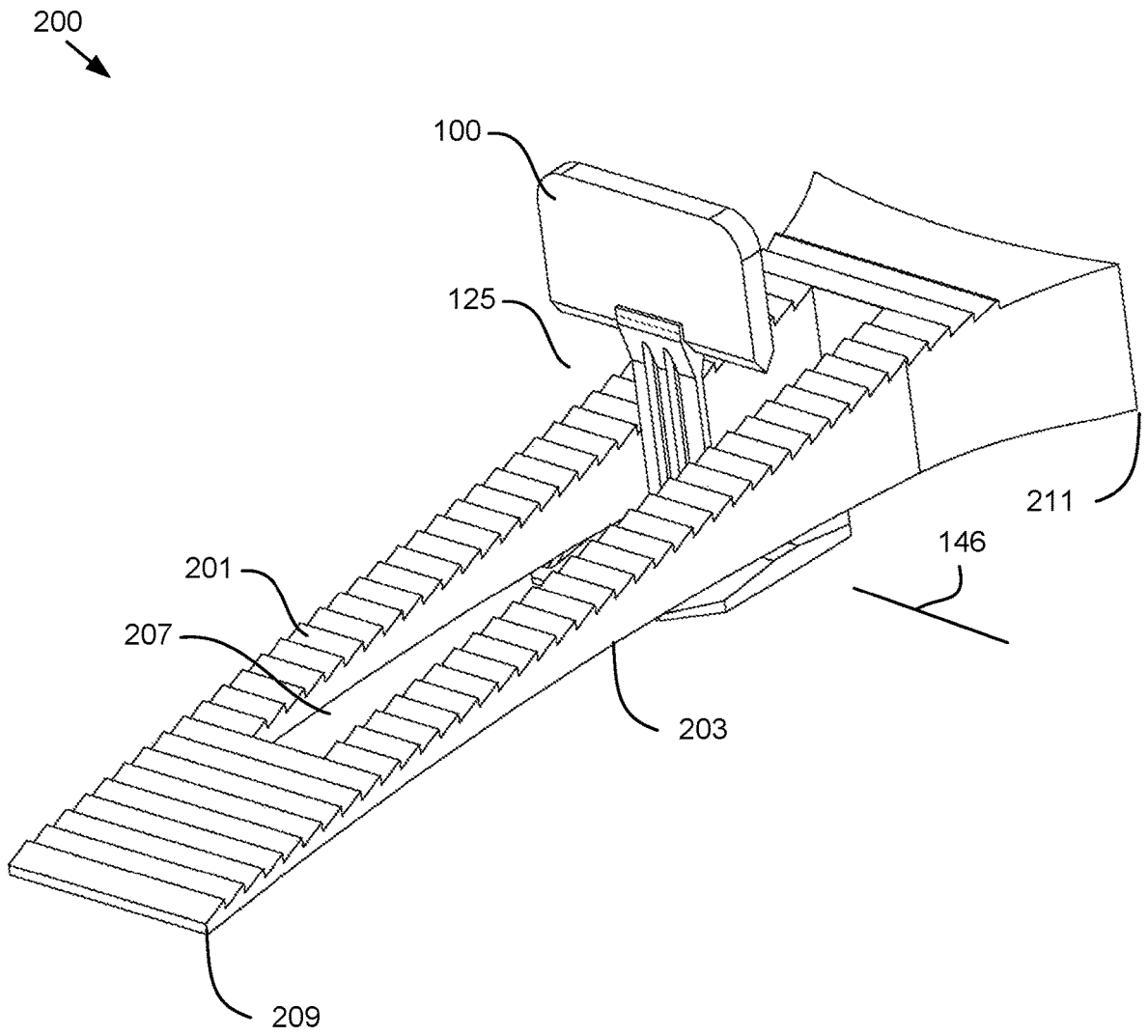
FIG. 11A is a perspective drawing illustrating one embodiment of a tensioner and tile leveling device.

FIG. 11A is a perspective drawing illustrating one embodiment of a tensioner 200 and the tile leveling device 100. In the depicted embodiment, the tensioner 200 includes a tapered surface 201 and a leveling surface 203. The leveling surface 203 may be disposed on the proximal surfaces 301 of one or more tiles 300. In one embodiment, the leveling surface 203 is a flat surface. Alternatively, the leveling surface 203 may be a curved surface. In a certain embodiment, the leveling surface 203 is a combination of one or more flat surfaces and one or more curved surfaces.

The tapered surface 201 may be inclined at a taper angle in the range of 15 to 35% relative to the leveling surface 203. In one embodiment, the taper angle is relative to a virtual plane containing a front edge 209 and a rear edge 211 of the leveling surface 203 of the tensioner 200.

The tile leveling device 100 may be positioned with the tensioner 200 in the tension gap 125. In the depicted embodiment, a single strut 115 is disposed within a tensioner trough 207.

In the depicted embodiment, the tile leveling device 100 comprises the single strut 115 that is substantially centered along the longitudinal axis 146 of the base 120. The tension gap 125 is formed between the cross piece 110 and the base 120 on both sides of the strut 115 along the longitudinal axis 146. The tensioner 200 is forced through the tension gap 125 on both sides of the strut 115.

Figure 11B:
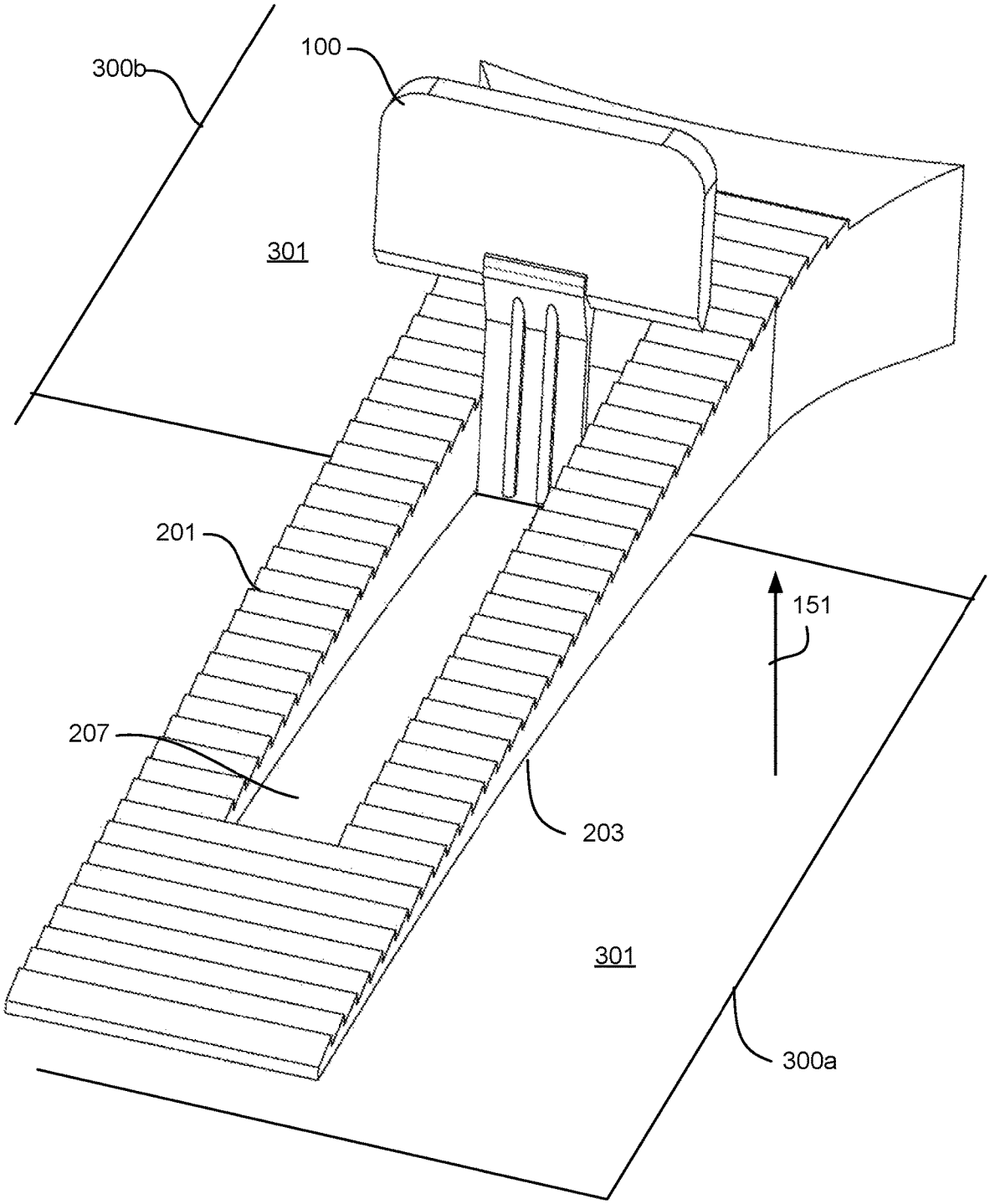
FIG. 11B is a perspective drawing illustrating one embodiment of a tensioner and tile leveling device disposed on tiles.

FIG. 11B is a perspective drawing illustrating one embodiment of a tensioner 200 and tile leveling device 100 of FIG. 11A disposed on tiles 300. A distal surface 303 of the first tile 300*a* is disposed on a proximal ridge surface 132 of the leveling ridges 130 (not shown). The at least one strut 115 may be disposed against an edge of the first tile 300*a*. A distal surface 303 of a second tile 300*b* is disposed on the at least one leveling ridge 130. The at least one strut 115 is disposed against an edge of the second tile 300*b*. A portion of the tension gap 125 and the cross piece 110 are disposed in the proximal direction 151 from a proximal surface 301 of the first tile 300*a* and the second tile 300*b*.

The tensioner 200 may be forced through the tension gap 125 until the tapered surface 201 contacts the cross piece 110, applying a leveling force to the first tile 300*a* and the second tile 300*b* from the leveling surface 130 of the tensioner 200 and the leveling ridges 130.

Figure 11C:
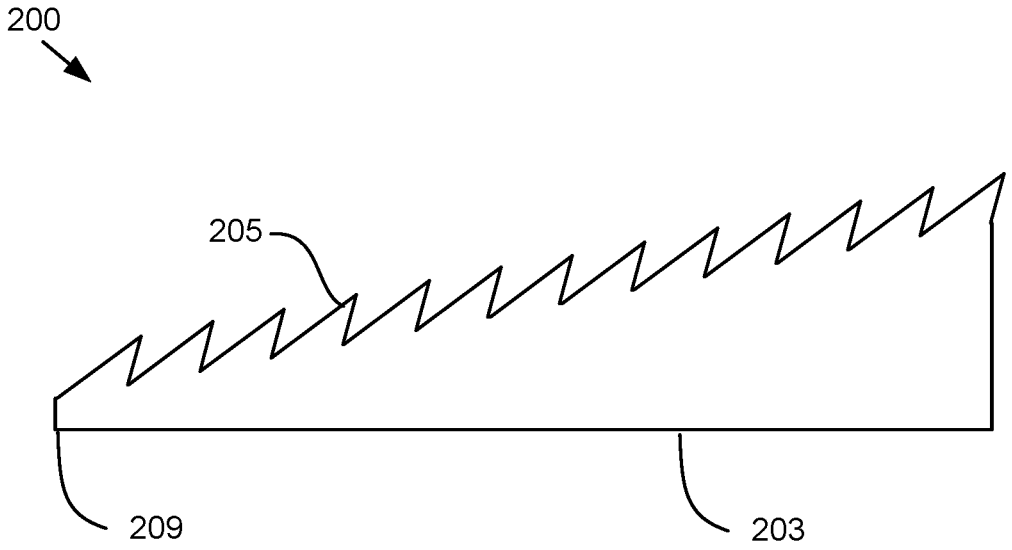
FIG. 11C is a side view drawing illustrating one embodiment of a tensioner.

FIG. 11C is a side view drawing of a tensioner 200. In particular, a front of the tensioner 200 including the front edge 209 is shown. In the depicted embodiment, the tapered surface 201 comprises ridges 205 that impede extracting the tensioner 200 from the tension gap 125. For example, the ridges 205 may catch on the cross piece 110.

Figure 11D:
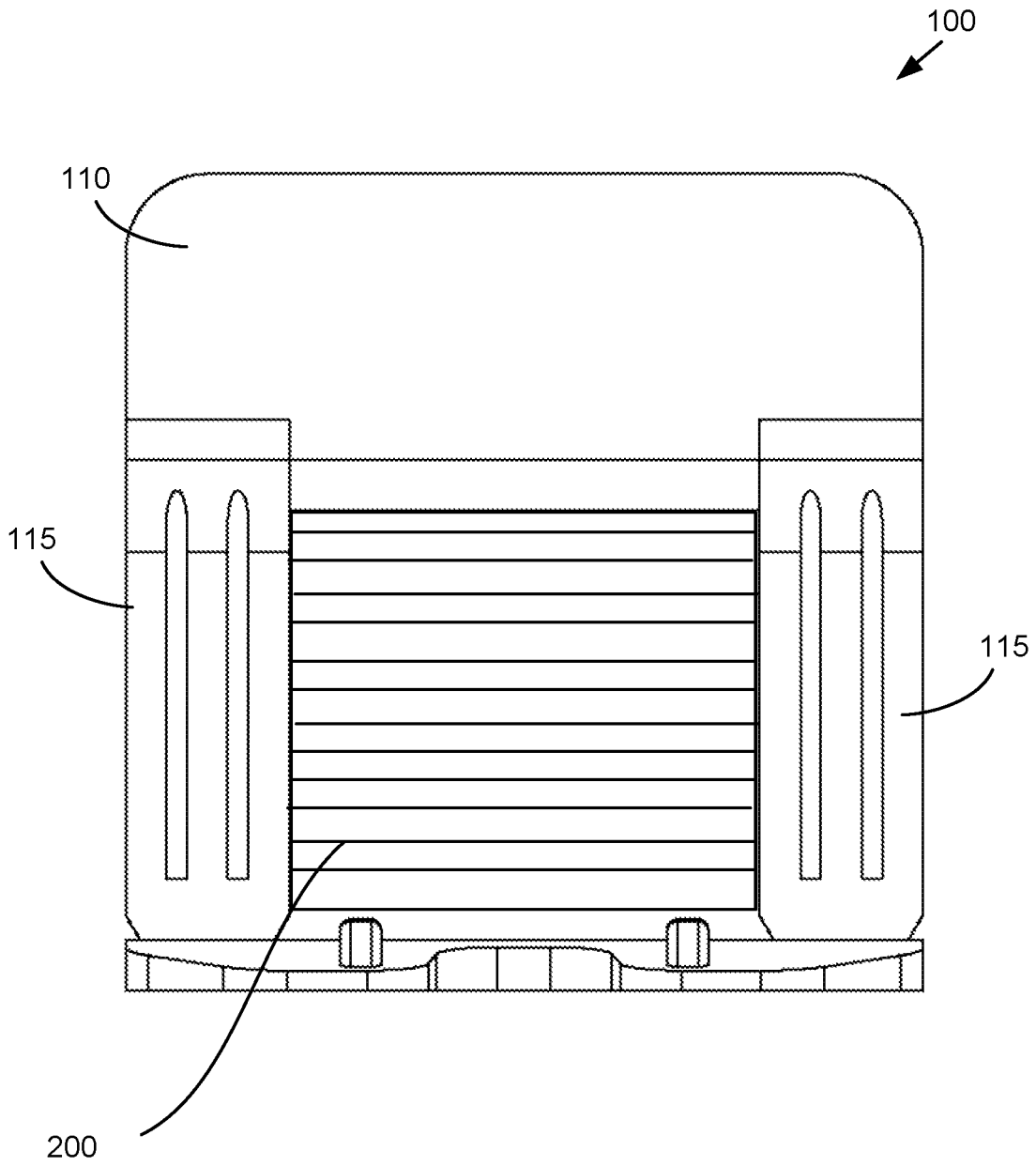
FIG. 11D is a front view drawing illustrating one embodiment of a tensioner and leveling device.

FIG. 11D is a front view drawing illustrating one embodiment of a tensioner 200 and a tile leveling device 100. In the depicted embodiment, the tile leveling device 100 comprises two struts 115. The tension gap 125 is bounded by the cross piece 110, the two struts 115, and the base 120. The tensioner 200 is forced through the tension gap 125 between the two struts 115.

The embodiments level tile 300 with leveling ridges 130 that are set above the base 120. As a result, mortar may freely flow between the base 120 and the tile 300. In addition, the break line 141 for the struts 115 are disposed the offset distance 147 from the proximal ridge surface 132 of the leveling ridges 130. As a result, the setting of the mortar relative to the base 120 is improved.

Figure 12A:
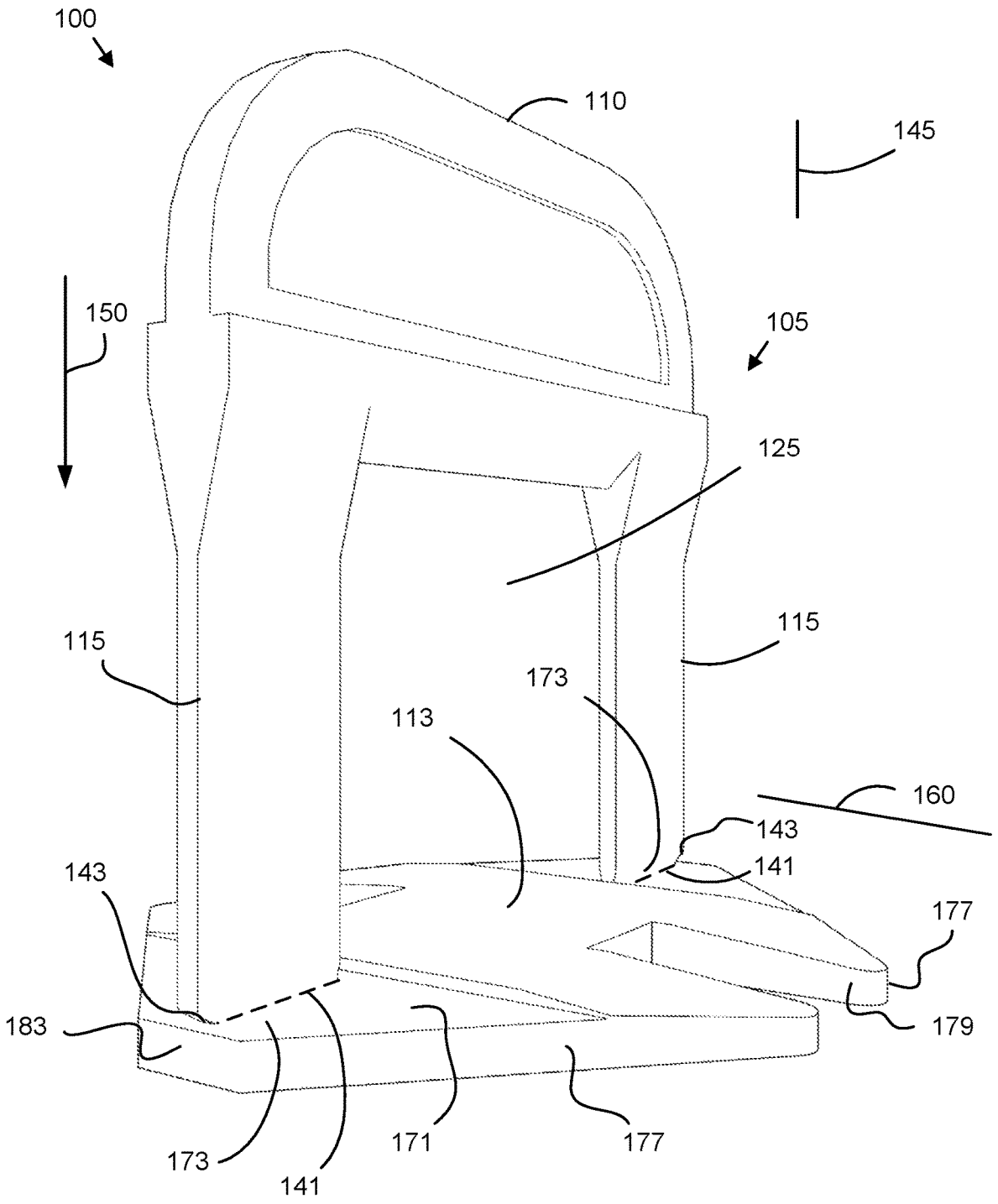
FIG. 12A is a side perspective drawing illustrating one alternate embodiment of a tile leveling device.

FIG. 12A is a side perspective drawing illustrating one alternate embodiment of a tile leveling device 100. The tile leveling device 100 includes a tower 105 and a device base 171. The tower 105 includes a cross piece 110 and two struts 115 that extend in the distal direction 150 along the first axis 145 from the cross piece 110.

The device base 171 is connected to the two struts 115 at a base intersection 173. The device base 171 extends along a traverse axis 160 from the two struts 115. The device base 171 may include two base triangles 177. Each base triangle 117 may include an outer triangle vertices 183. Each strut 115 comprises a notch 143 along a break line 141 at an outer intersection of the strut 115 and the device base 171.

The tile leveling device 100 further includes a leveling stage 113. The leveling stage 113 is disposed on a proximal surface of the device base 171. The leveling stage 113 may receive a tile. The cross piece 110, the two struts 115, and the leveling stage 113 form the tension gap 125.

Figure 12B:
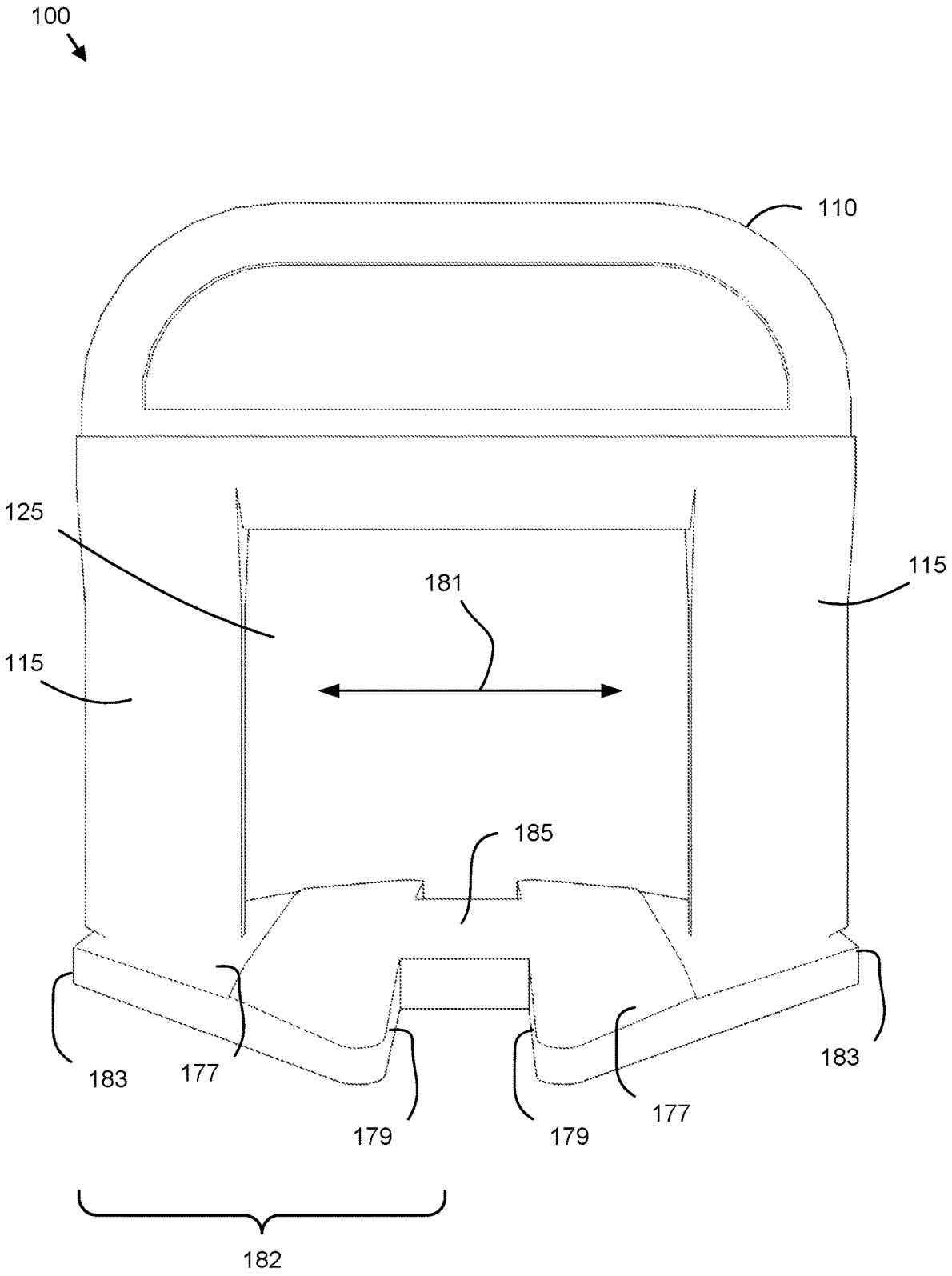
FIG. 12B is a front perspective drawing illustrating one alternate embodiment of a tile leveling device.

FIG. 12B is a front perspective drawing illustrating the tile leveling device 100 of FIG. 12A. Each base triangle 177 may have opposing inner triangle sides 179 along a cross axis 181. The outer triangle vertices 183 may be along the cross axis 181. The outer vertices 183 may be flattened. The two base triangles 177 may be connected by a base bar 185 along the cross axis 181. The flattened outer vertices 183 and/04 strut outer edges extend outward an outer distance 182 along the cross axis 181. The base bar 185 may have a width in the range of 5 to 25 mm along the traverse axis 160.

Figure 13A:
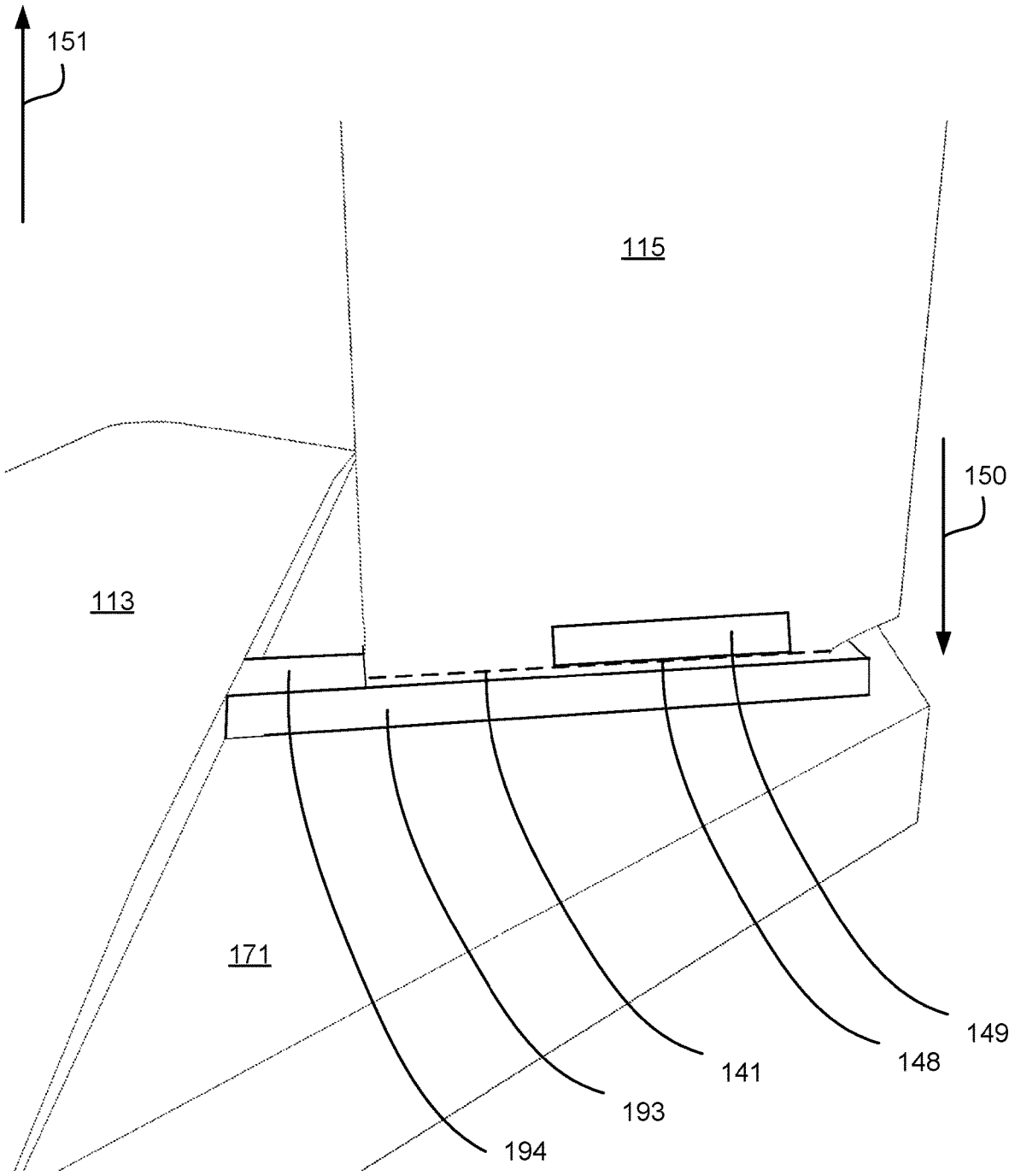
FIG. 13A is a perspective drawing illustrating one embodiment of a break area.

FIG. 13A is a perspective drawing illustrating one embodiment of a break area 149 for the tile leveling device 100 of FIGS. 12A-B. Each strut 115 may include the break area 149 positioned with a break area distal edge 148 along the break line 141. The break area 149 may be a rectangle. The break area 149 may extend in the range of 3 to 20 millimeters in the proximal direction 151.

The tile leveling device 100 may include a break ridge 193 that extends in the proximal direction 151 from the device base 171 and/or base triangle 117 base triangle 117. The break line 141 may be along a proximal side 194 of the break ridge 193.

Figure 13B:
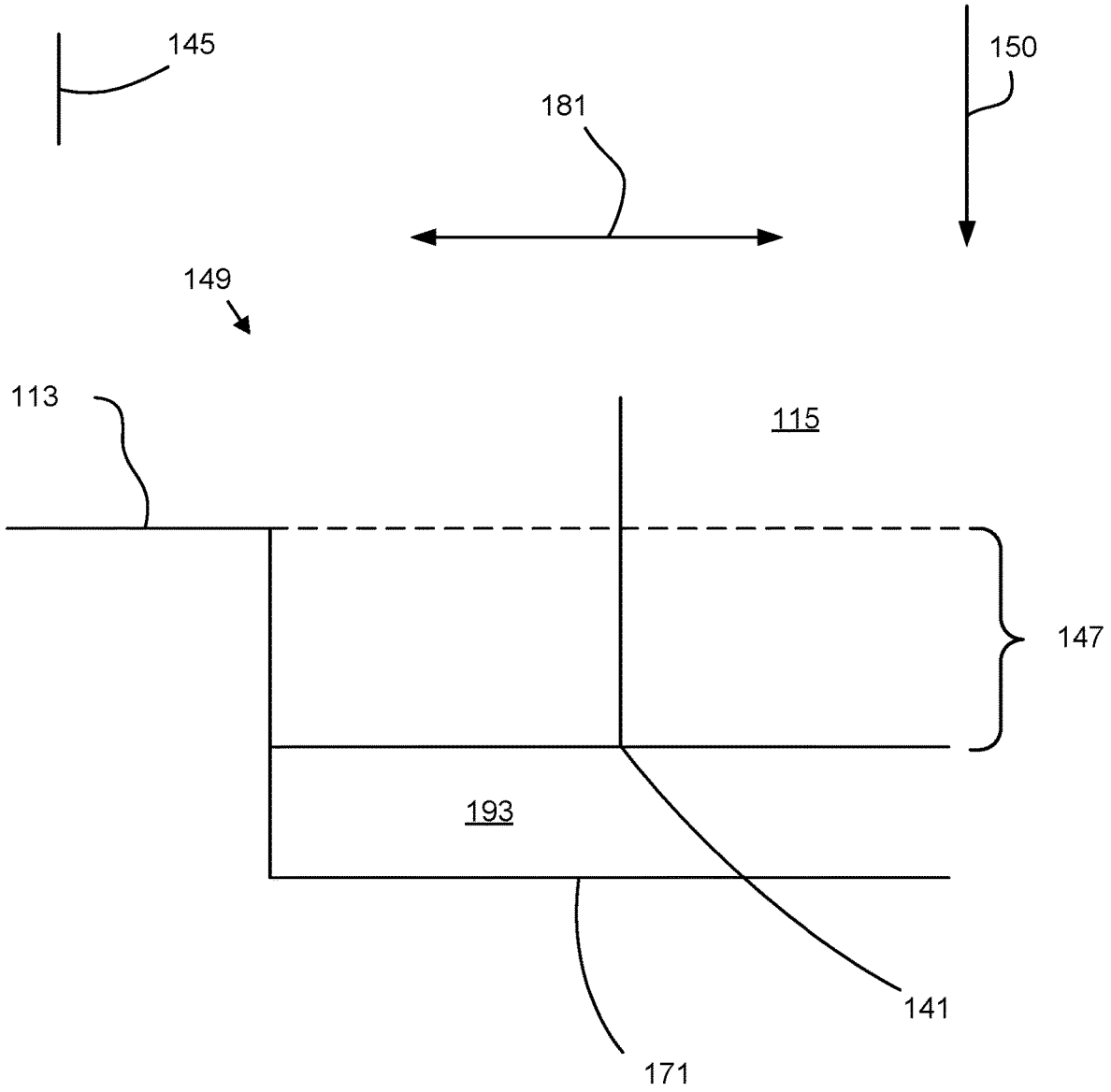
FIG. 13B is a side view drawing illustrating one embodiment of a break area.

FIG. 13B is a side view drawing illustrating one embodiment of a break area 149. In the depicted embodiment, the break line 141 is disposed an offset distance 147 in the distal direction 150 along the first axis 145 from the leveling stage 113. The offset distance 147 may be in the range of 1 to 12 mm. The break line 141 may be on the break ridge 193.

Figure 14A:
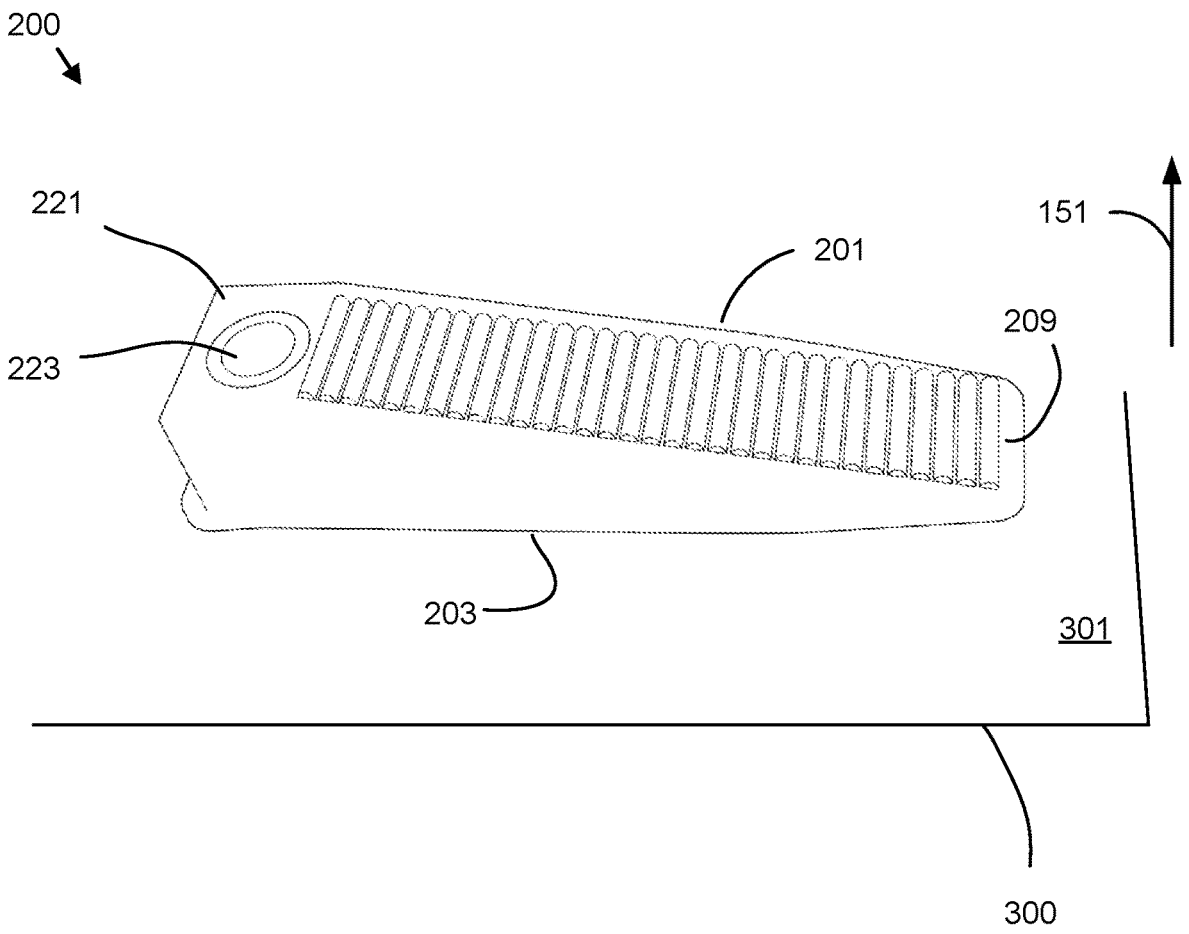
FIG. 14A is a side perspective drawing illustrating one alternate embodiment of a tensioner.

FIG. 14A is a side perspective drawing illustrating one alternate embodiment of a tensioner 200. The tensioner 200 includes a leveling surface 203, a tapered surface 201, a leveling platform 221, and a bubble level 223.

The leveling surface 203 is disposed on proximal surfaces 301 of first and/or second tiles 300. The tapered surface 201 may taper from a front edge 209 disposed opposite the leveling surface to the level platform 221.

The bubble level 223 may be embedded in the leveling platform 221. The bubble level 223 indicates whether the leveling platform 223 and/or the leveling surface 203 is level.

Figure 14B:
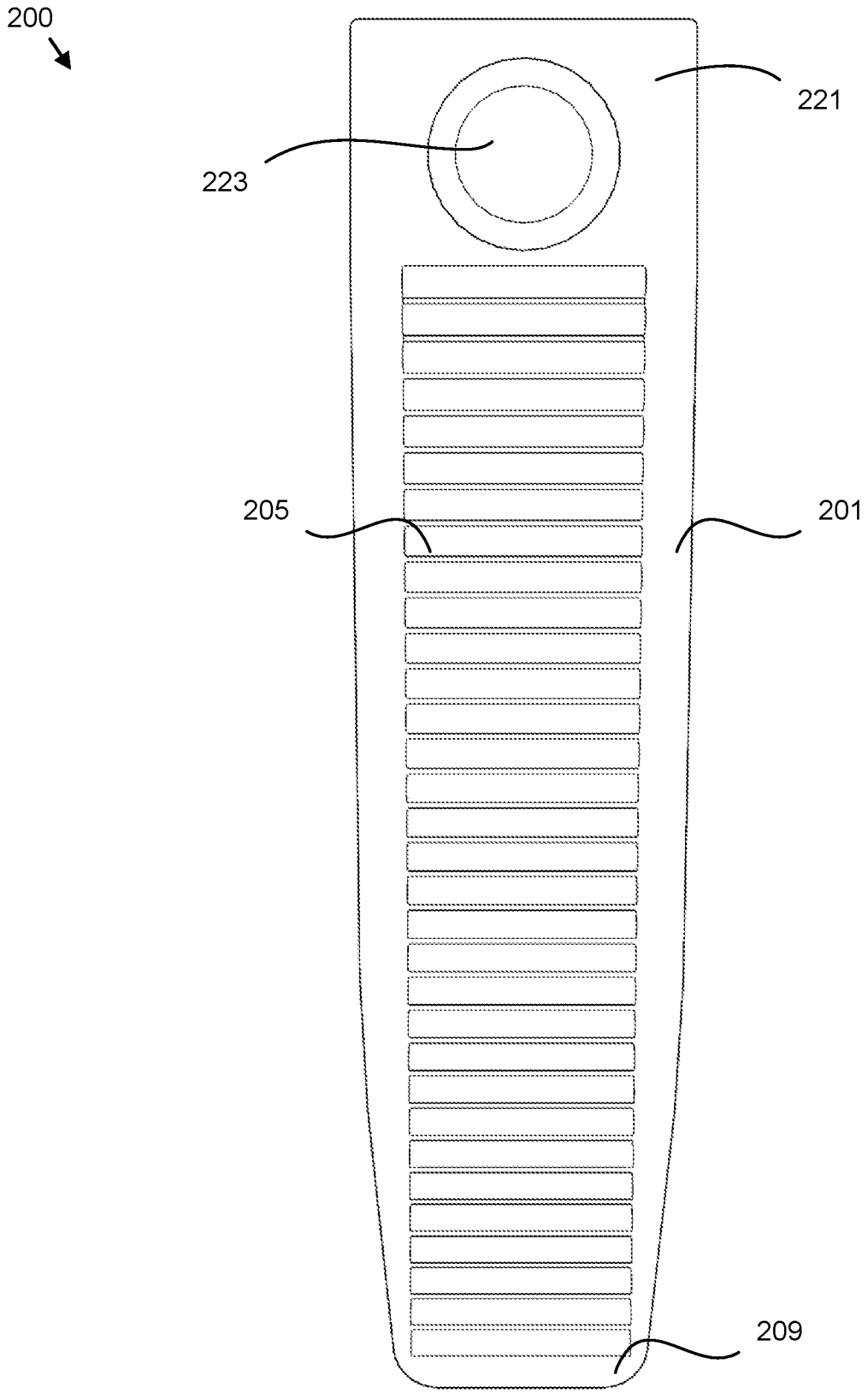
FIG. 14B is a top view drawing illustrating one alternate embodiment of a tensioner.

FIG. 14B is a top view drawing illustrating one alternate embodiment of the tensioner 200 of FIG. 14A. The tensioner 200 is forced through the tension gap 125 until the tapered surface 201 contacts a cross piece 110, applying a leveling force to the first and second tiles 300 from the leveling surface 203 of the tensioner 200 and the leveling ridges 205.

Figure 14C:
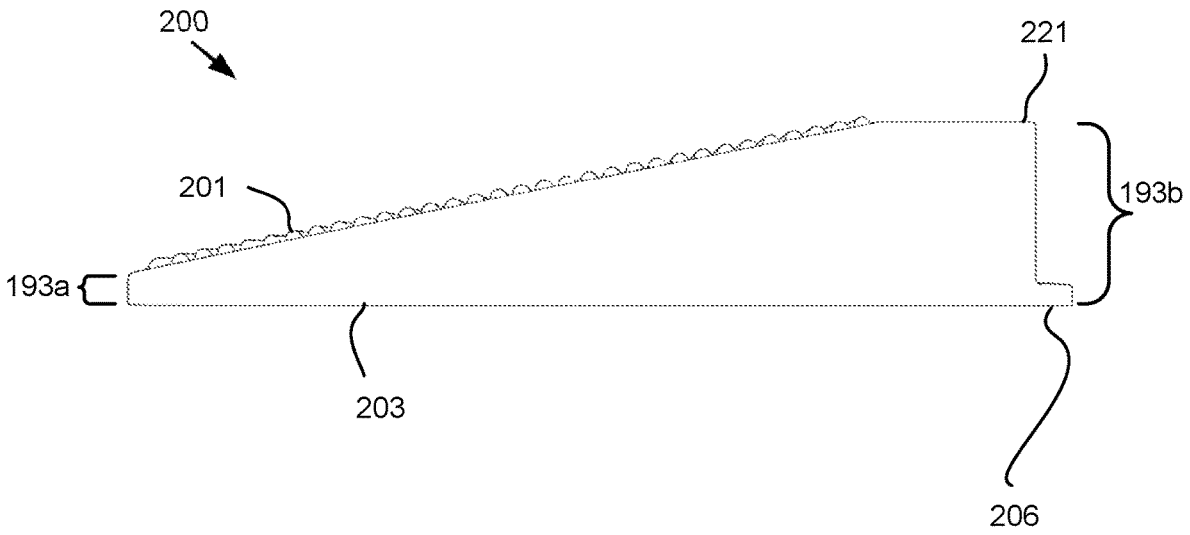
FIG. 14C is a side view drawing illustrating one alternate embodiment of a tensioner.

FIG. 14C is a side view drawing illustrating one alternate embodiment of the tensioner 200 of FIGS. 14A-B. A first separation distance 193*a* is between the tapered surface 201 at the front edge 209 and the leveling surface 203. The leveling platform 221 separated by a second separation distance 193*b* from the leveling surface 203. The leveling platform 221 is parallel to the leveling surface 203. In one embodiment, the tensioner 200 includes a heel 206.

Figure 14D:
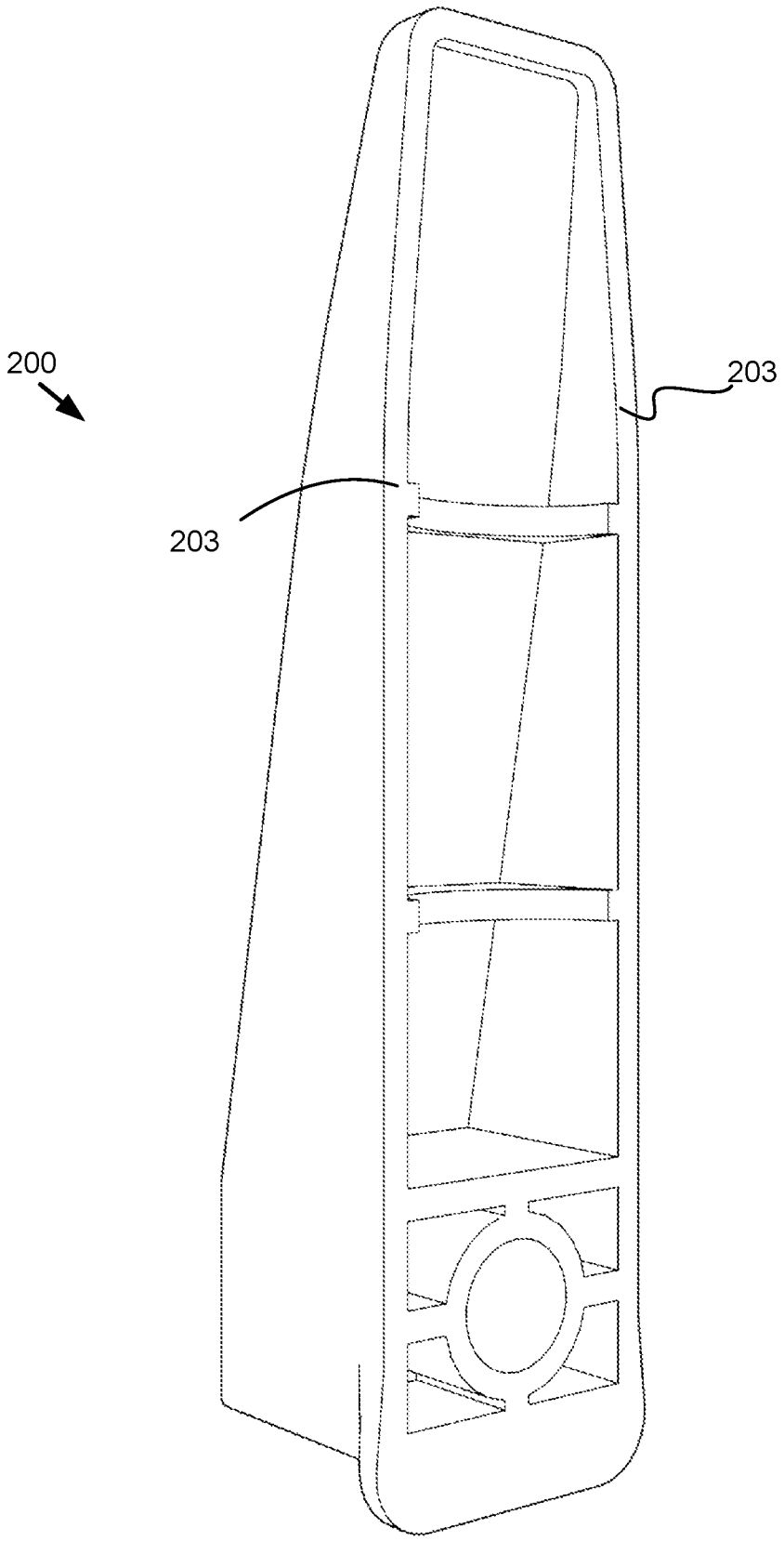
FIG. 14D is a bottom perspective drawing illustrating one alternate embodiment of a tensioner.

FIG. 14D is a bottom perspective drawing illustrating one alternate embodiment of the tensioner 200 of FIGS. 14A-C. The leveling surface 203 is shown. The entire leveling surface 203 may be coplanar.

Figure 15A:
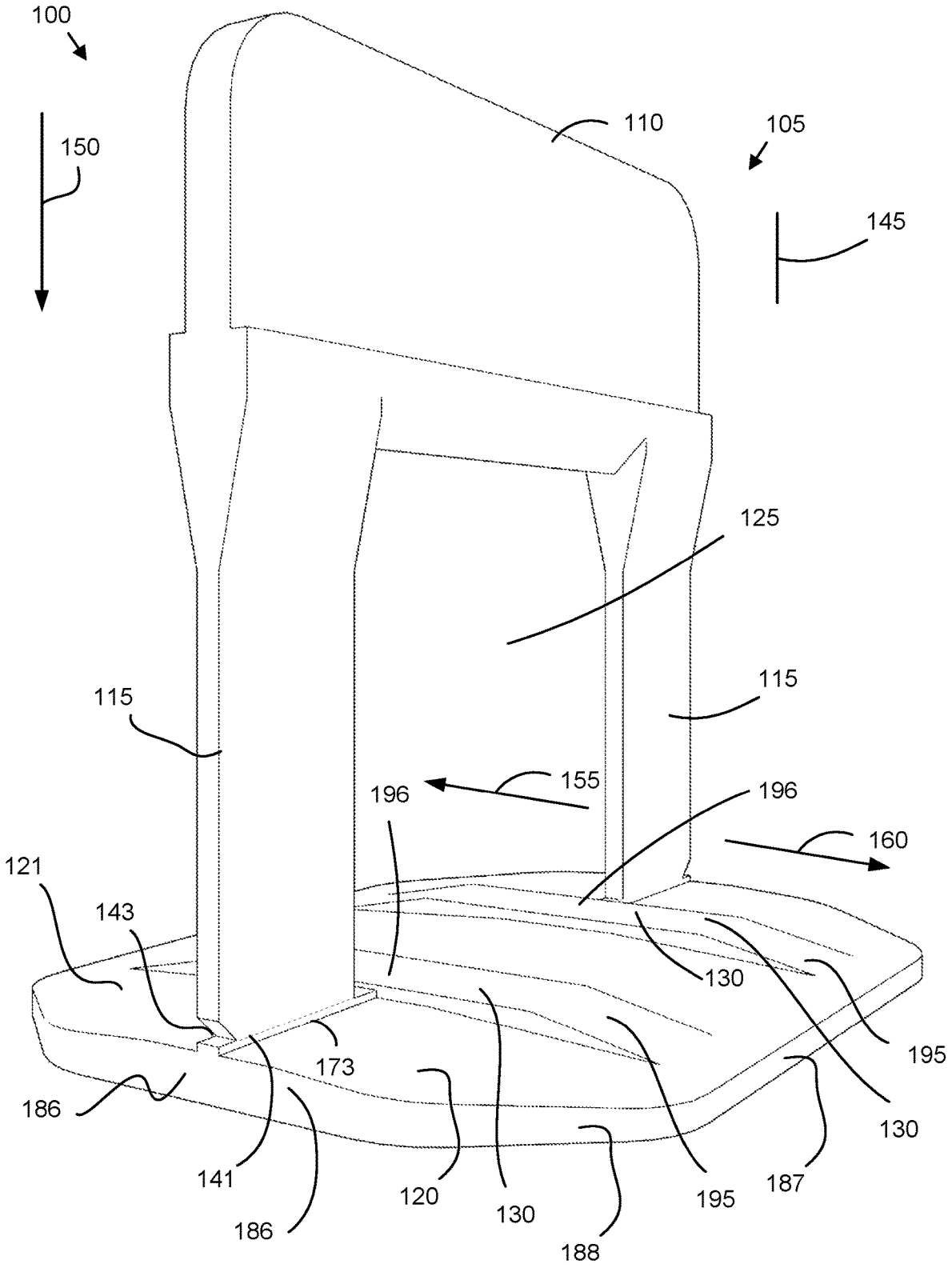
FIG. 15A is a side perspective drawing illustrating one embodiment of a tile leveling device.

FIG. 15A is a side perspective drawing illustrating one alternate embodiment of a tile leveling device 100. The tile leveling device 100 includes a tower 105 and a base 120. The tower 105 includes a cross piece 110 and two struts 115 that extend in the distal direction 150 along the first axis 145 from the cross piece 110.

The base 120 is connected to the two struts 115 at a base intersection 173. The base 120 extends along the first traverse direction 155 and the second traverse axis 160 from the two struts 115. Each strut 115 comprises a notch 143 along a break line 141 at an outer intersection of the strut 115 and the device base 171.

The base 120 includes side edges 186 and front edges 187. In one embodiment, the base 120 includes a diagonal cutout 188. The base 120 may include leveling ridges 130 disposed on the base 120. The leveling ridges 130 may receive one or more tiles 300. The cross piece 110, the two struts 115, the base 120, and/or the leveling ridges 130 form the tension gap 125.

In one embodiment, the base 120 is connected to the two struts 115 at a base intersection 173. The device base 171 includes two side edges 186, two front edges 187, and four diagonal cutouts 188. The two side edges 186 are each perpendicular to both the two front edges 187. A diagonal cutout 188 is between each side edge 186 and front edge pair 187 at a diagonal angle and each strut 115 comprises a notch 143 along a break line 141 at an outer intersection 173.

Two leveling ridges 130 may be disposed on a proximal surface 121 of the base 120. Each leveling ridge 130 includes a platform 196 perpendicular to the first axis 145 and/or the two struts 115. The two platforms 196 may form the tension gap 125. Each platform 196 extends unbroken through the tension gap 125. Each leveling ridge 130 may include leveling ramps 195 that slope from the platform 196 along the traverse axis 160 to the proximal surface 121.

Figure 15B:
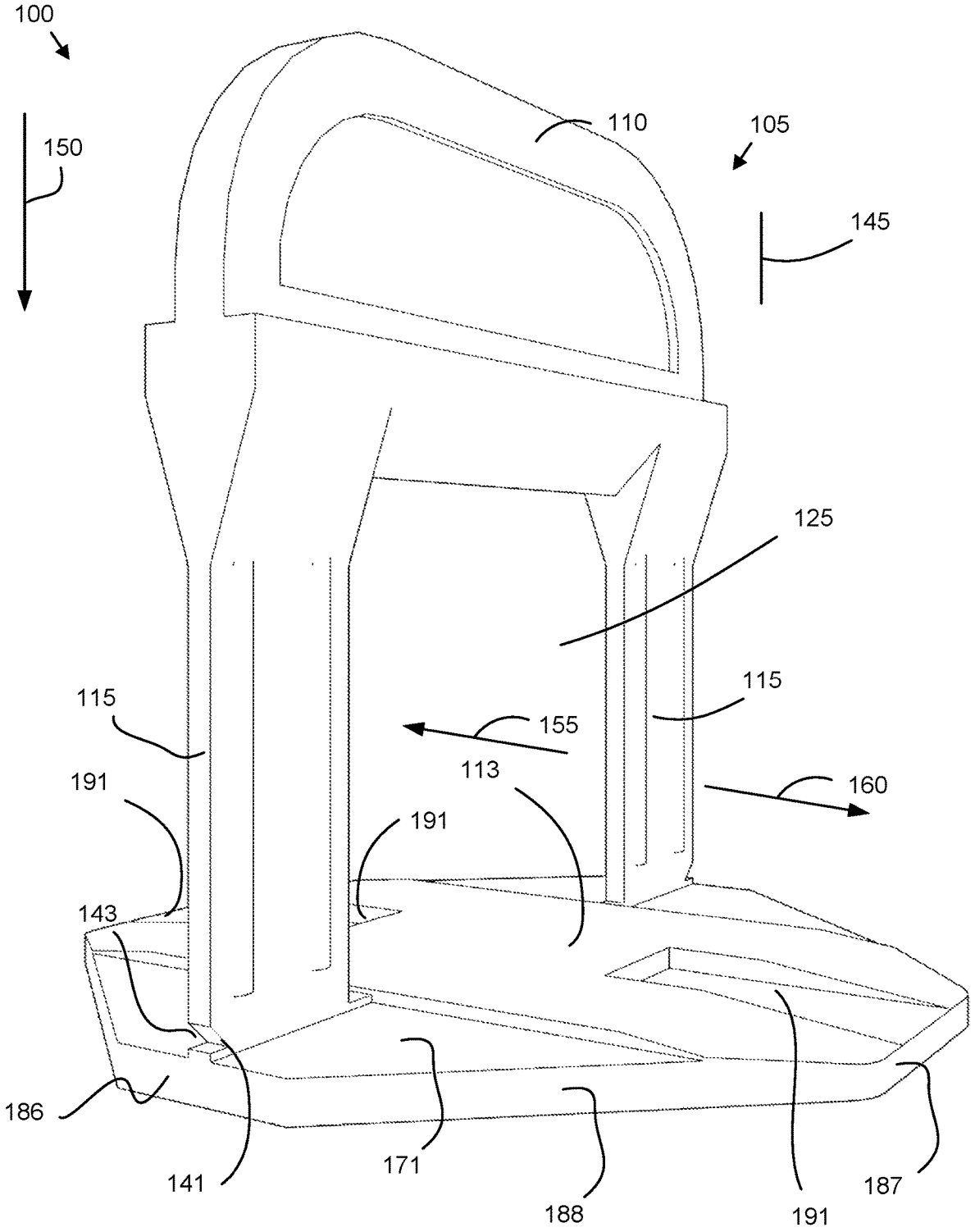
FIG. 15B is a side perspective drawing illustrating one alternate embodiment of a tile leveling device.

FIG. 15B is a side perspective drawing illustrating one alternate embodiment of a tile leveling device 100. The tile leveling device 100 includes a tower 105 and a device base 171. The tower 105 includes a cross piece 110 and two struts 115 that extend in the distal direction 150 along the first axis 145 from the cross piece 110.

The device base 171 is connected to the two struts 115 at a base intersection 173. The device base 171 extends along the traverse axis 160 from the two struts 115. Each strut 115 comprises a notch 143 along a break line 141 at an outer intersection of the strut 115 and the device base 171.

The device base 171 includes side edges 186 and front edges 187. In one embodiment, the device base 171 includes a diagonal cutout 188.

The tile leveling device 100 includes the leveling stage 113 disposed on the device base 171. The leveling stage 113 may receive one or more tiles 300. The cross piece 110, the two struts 115, and the leveling stage 113 form the tension gap 125.

In one embodiment, the leveling stage 113 includes two recesses 191 extending in the first traverse direction 155 and the second traverse direction 160 respectively. The recesses 191 may receive mortar while leveling the one or more tiles 300.

Figure 16A:
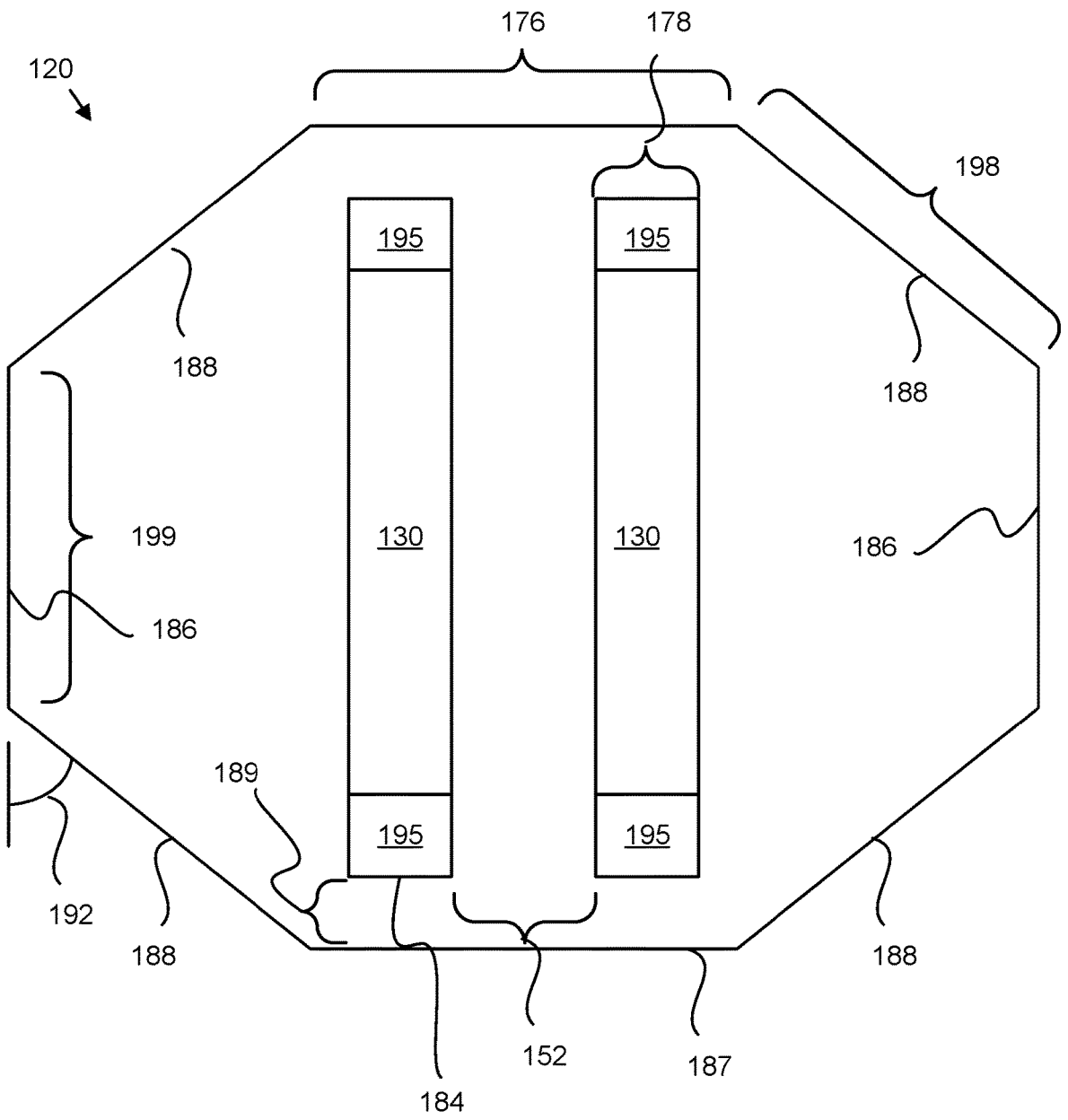
FIG. 16A is a top view drawing illustrating one alternate embodiment of a base of a tile leveling device.

FIG. 16A is a top view drawing illustrating one embodiment of the base 120 of FIG. 15A. Dimension proportions may be different from what is shown. The intersection 184 of each leveling ramp 195 and the proximal surface 121 may be separated from a nearest front edge 187 by a proximal surface gap 189.

The diagonal angle 192 is shown. The diagonal angle 192 may be in the range of 40 to 50 degrees. In one embodiment, the diagonal angle 192 is in the range of 25 to 65 degrees. A platform width 178 is shown. A diagonal cutout length 198 may be greater than a side edge length 199. The diagonal cutout length 198 may be greater than half side edge length 199. In one embodiment, the diagonal cutout length 198 is less than the side edge length 199. The diagonal cutout length 198 may be less than half side edge length 199.

The diagonal cutout length 198 may be greater than a front edge length 176. The diagonal cutout length 198 may greater than a half the front edge length 176. The diagonal cutout length 198 may less than a front edge length 176. The diagonal cutout length 198 may less than a half the front edge length 176.

A platform gap 152 between the two platforms 130 may greater than twice the platform width 178. In addition, the platform gap 152 between the two platforms 130 may greater than the platform width 178.

Figure 16B:
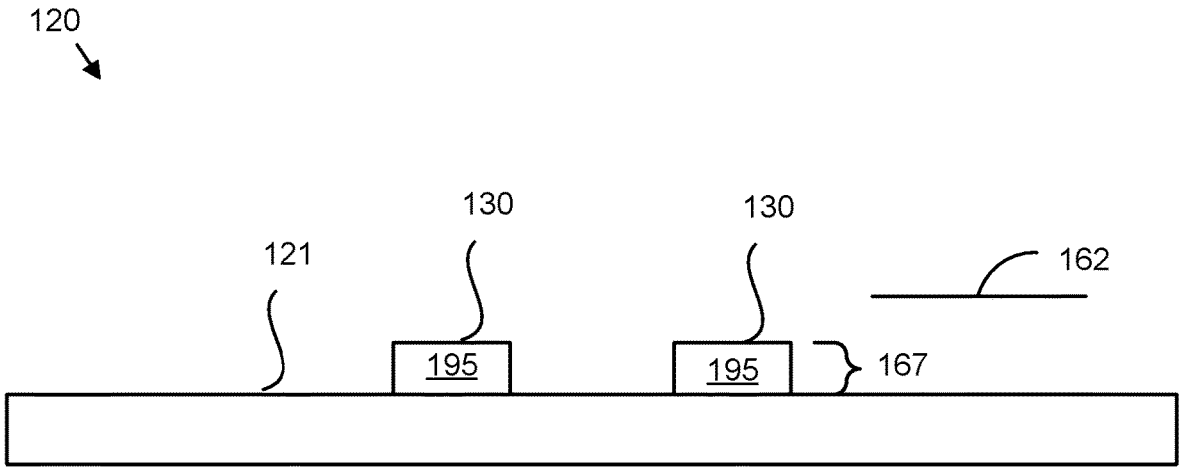
FIG. 16B is a side view drawing illustrating one alternate embodiment of a base of a tile leveling device.

FIG. 16B is a side view drawing illustrating one embodiment of a base 120 of FIG. 16A. A platform height 167 is shown from the proximal surface 121 along the first axis 145 to a proximal surface of the platform 130. The platform height 167 may be at least one quarter the platform width 178 along a cross axis 162. Alternatively, the platform height 167 may be less than one quarter the platform width 178 along a cross axis 162.

Figure 17:
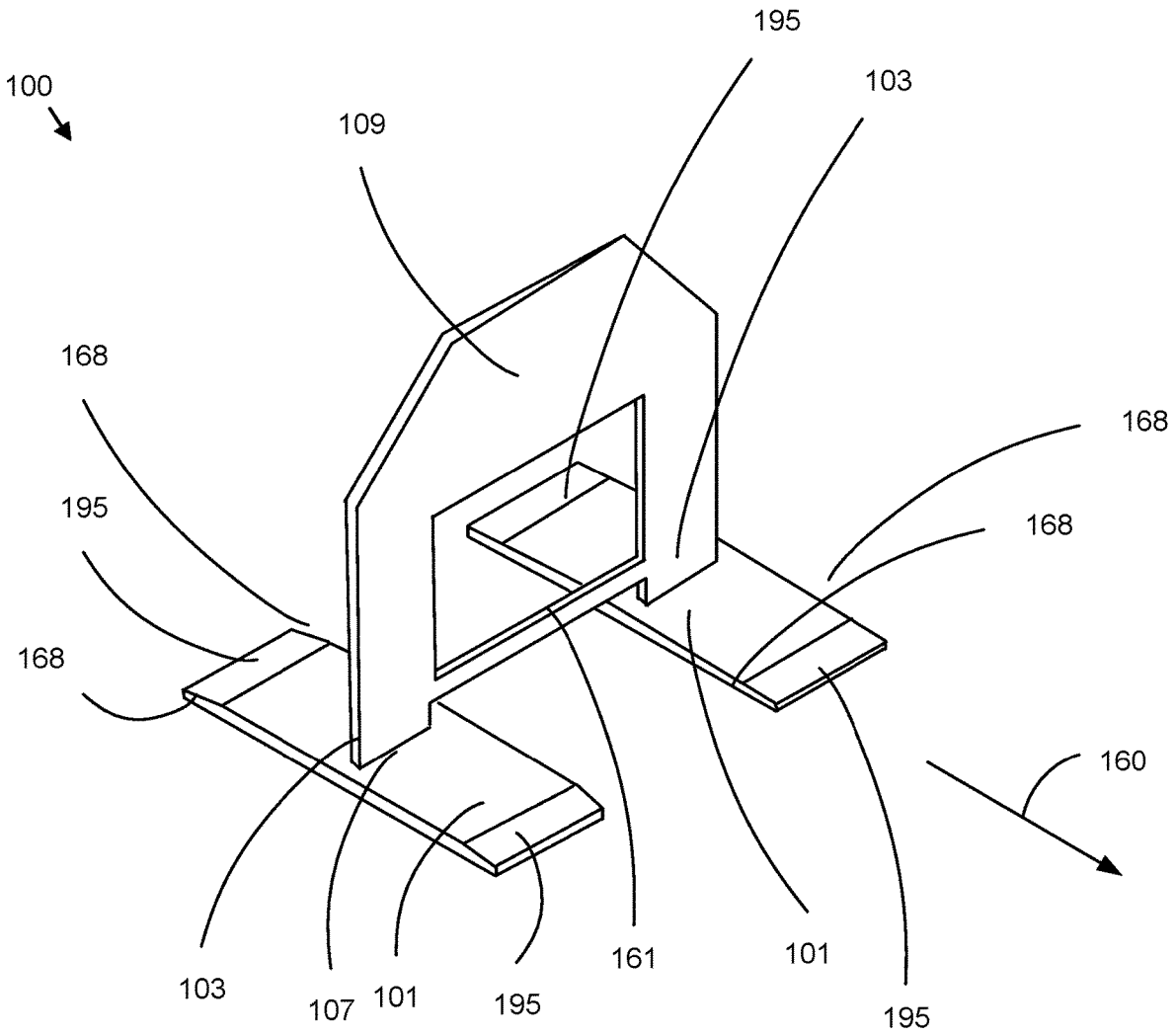
FIG. 17 is a perspective drawing illustrating one embodiment of a tile leveler.

FIG. 17 is a perspective drawing illustrating one embodiment of a tile leveler 100. The tile leveler 100 includes two bases 101, two columns 103, and a traverse bar 105. Each base 101 connects to one column 103 at a break line 107. The column 103 may be separated from the corresponding base 101 at the break line 107. In the depicted embodiment, a cross bar 109 connects the two columns 103. The cross bar 109, two columns 103, and traverse bar 161 may form a window.

In one embodiment, each base 101 includes base rails 168. Each base rail 168 may have a rail height that is equal to a base height.

Each base 101 may have leveling ramps 195 that slope down along the traverse axis 160.

Figure 18:
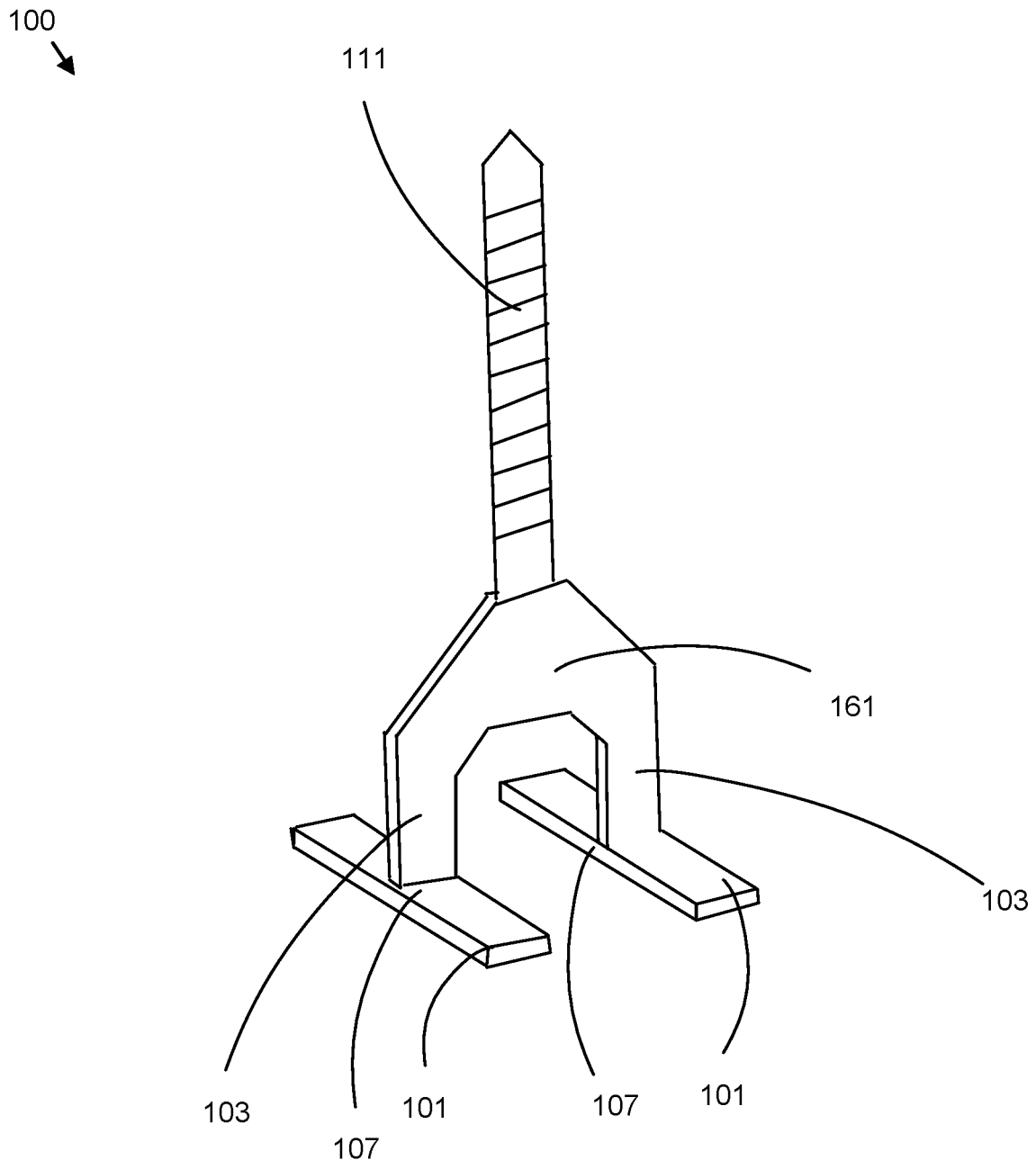
FIG. 18 is a perspective drawing illustrating one embodiment of a tile leveler.

FIG. 18 is a perspective drawing illustrating one embodiment of a tile leveler 100. The tile leveler 100 includes two bases 101, two columns 103, and a traverse bar 161. Each base 101 connects to one column 103 at a break line 107. The column 103 may be separated from the corresponding base 101 at the break line 107. In the depicted embodiment, a threaded shaft 111 is connected to the traverse bar 161. A threaded clamp (not shown) may be screwed on to the threaded shaft 111 to apply a leveling force to a tile.

Figure 19:
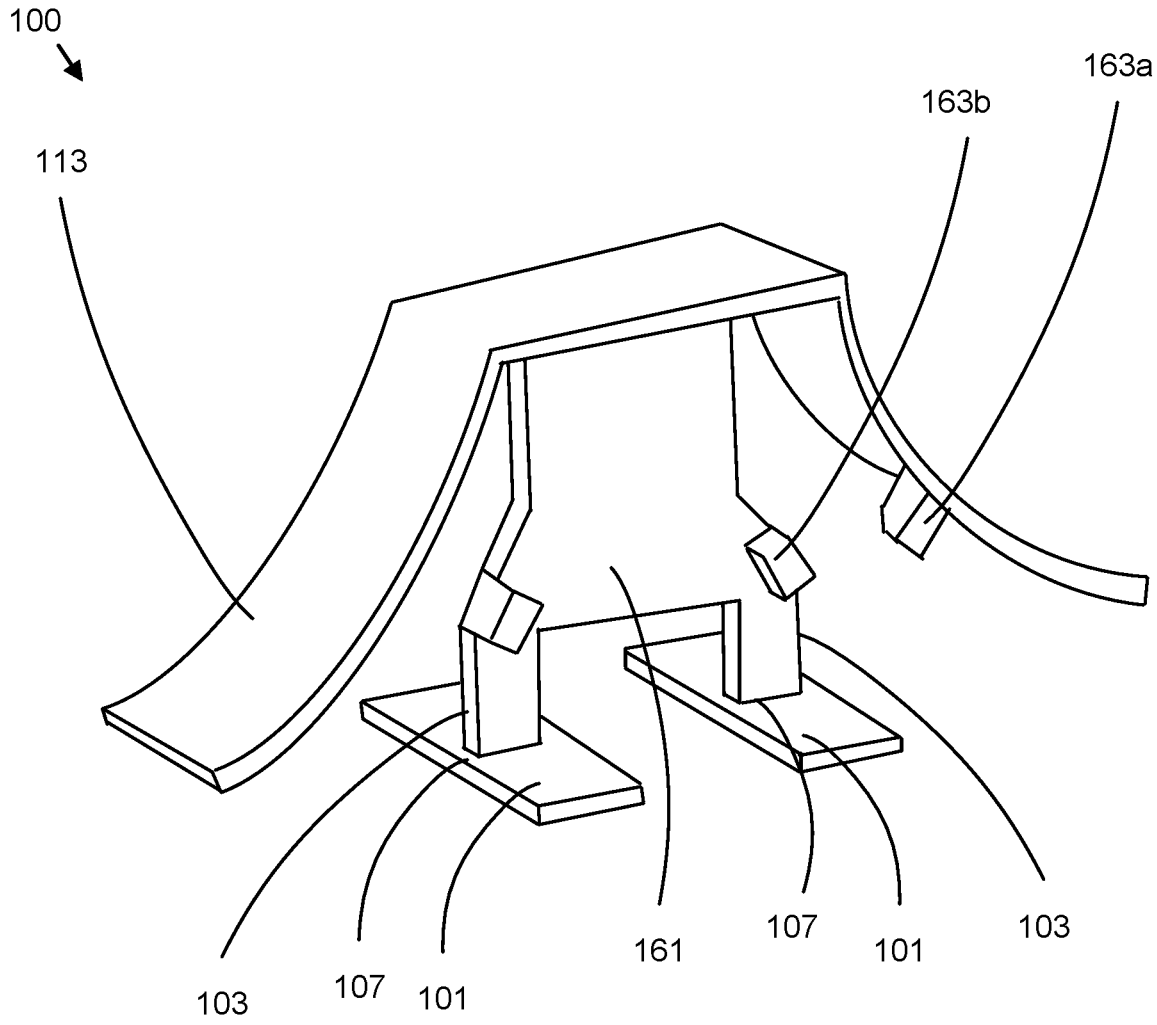
FIG. 19 is a perspective drawing illustrating one embodiment of a tile leveler.

FIG. 19 is a perspective drawing illustrating one embodiment of a tile leveler 100. The tile leveler 100 includes two bases 101, two columns 103, and a traverse bar 161. Each base 101 connects to one column 103 at a break line 107. The column 103 may be separated from the corresponding base 101 at the break line 107. In the depicted embodiment, at least one clamp 113 may be pivotably connected to one column 103 with a latch 163*a/b*.

Figure 20:
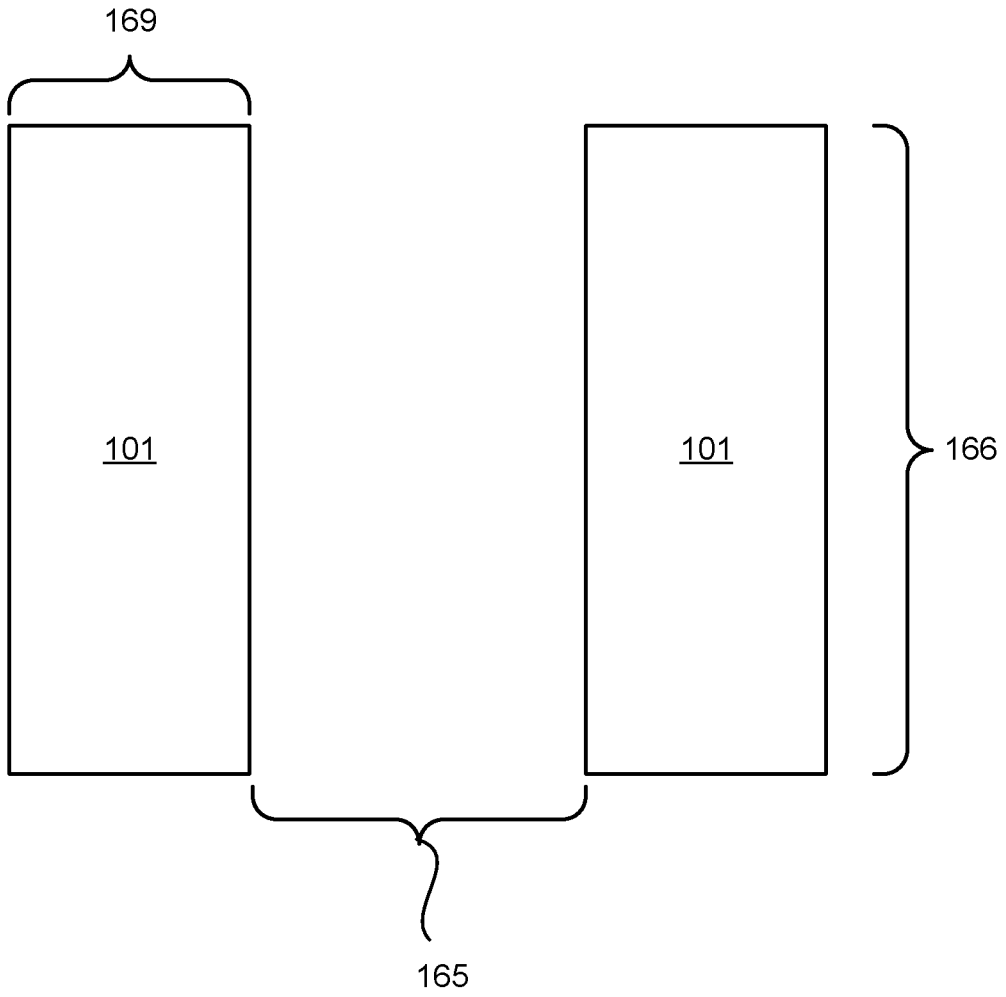
FIG. 20 is a bottom view drawing illustrating one embodiment of bases.

FIG. 20 is a bottom view drawing illustrating one embodiment of bases 101. In the depicted embodiment, the bases 101 of FIGS. 17-19 are shown. The bases 101 have a base width 169. The two bases 101 are separated by a base gap 165. The base gap 165 may be greater than the base width 169. The base gap 165 may be in the range of 1.05 to 2 times the base width 169. The base gap 165 may be 1.2 times the base width 169. In addition, the base gap 165 may be 1.3 times the base width 169.

Each base 101 has a base length 166. The base length 166 may be greater than the base gap 165. The base length 166 may be in the range of 1.8 to 4 times the base gap 165. The base length 166 may be 2.1 times the base gap 165.

Embodiments may be practiced in other specific forms. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The invention claimed is:

1. A tile leveling device comprising:

a tower comprising a cross piece and two struts that extend in a distal direction along a first axis from the cross piece;

a base connected to the two struts at a base intersection and extending along a traverse axis from the two struts, the base comprising two side edges, two front edges, and four diagonal cutouts, wherein the two side edges are each perpendicular to both the two front edges, a diagonal cutout is between each side edge and front edge pair at a diagonal angle and each strut comprises a notch along a break line at an outer intersection; and two leveling ridges disposed on a proximal surface of the base, each leveling ridge comprising a platform perpendicular to the first axis forming a tension gap and each platform extends unbroken through the tension gap, a platform height from the proximal surface along the first axis is at least one quarter a platform width along a cross axis and a platform gap between the each platform is greater than twice the platform width, each leveling ridge further comprising leveling ramps that slope from the platform along a traverse axis to the proximal surface, wherein an intersection of each leveling ramp and the proximal surface is separated from a nearest front edge by a proximal surface gap.

2. The tile leveling device of claim 1, wherein the diagonal angle is in the range of 40 to 50 degrees.

3. The tile leveling device of claim 1, wherein a diagonal cutout length is greater than a side edge length.

4. The tile leveling device of claim 1, wherein a diagonal cutout length is less than a side edge length.

5. The tile leveling device of claim 1, wherein a diagonal cutout length is greater than a front edge length.

6. The tile leveling device of claim 1, wherein a diagonal cutout length is less than a front length.

* * * * *